US008414182B2

(12) United States Patent
Paul et al.

(10) Patent No.: US 8,414,182 B2
(45) Date of Patent: Apr. 9, 2013

(54) MICROMIXERS FOR NANOMATERIAL PRODUCTION

(75) Inventors: Brian Kevin Paul, Corvallis, OR (US); Anna Evelyn Garrison, Philomath, OR (US)

(73) Assignee: State of Oregon acting by and through the State Board of Higher Education on behalf of Oregon State University, Corvallis, OR (US)

( * ) Notice: Subject to any disclaimer, the term of this patent is extended or adjusted under 35 U.S.C. 154(b) by 900 days.

(21) Appl. No.: 12/414,597

(22) Filed: Mar. 30, 2009

(65) Prior Publication Data

US 2009/0245017 A1 Oct. 1, 2009

Related U.S. Application Data

(60) Provisional application No. 61/072,265, filed on Mar. 28, 2008.

(51) Int. Cl.
*B01F 13/00* (2006.01)

(52) U.S. Cl.
USPC ..... 366/341; 366/336

(58) Field of Classification Search ..... 366/341, 366/336
See application file for complete search history.

(56) References Cited

U.S. PATENT DOCUMENTS 5,595,712 A * 1/1997 Harbster et al. ..... 422/129
6,672,502 B1 1/2004 Paul et al.
6,793,831 B1 9/2004 Paul et al.
7,507,380 B2 3/2009 Chang et al.
2008/0108122 A1 5/2008 Paul et al.

FOREIGN PATENT DOCUMENTS

WO 2004/072419 8/2004
WO 2006/107206 10/2006

OTHER PUBLICATIONS

Ajmera et al., "Microfabricated differential reactor for heterogeneous gas phase catalyst testing," *Journal of Catalysis*, 209:401-412, 2002.
Amador et al., "Flow distribution in different microreactor scale-out geometries and the effect of manufacturing tolerances and channel blockage," *Chemical Engineering Journal*, 101:379-390, 2004.
Bejan et al., "Deterministic tree networks for fluid flow: geometry for minimal flow resistance between a volume and one point," *Fractals*, 5:685-695, 1997.
Chan et al., "Size-controlled growth of CdSe nanocystals in microfluidics reactors," *Nano Letters* 3(2):199-201, 2003.
Chang et al., "Progress towards chip-based high-throughput dendrimer synthesis," *IMRET8—8th International Conference on Microreaction Technology*, Atlanta, GA, Apr. 2005.
Ehrfeld et al., "Characterization of Mixing in Micromixers by a Test Reaction: Single Mixing Units and Mixer Arrays," *Ind. Eng. Chem. Res*. 38:1075-1082, 1999.

(Continued)

*Primary Examiner* — Yogendra Gupta
*Assistant Examiner* — John Robitaille
(74) *Attorney, Agent, or Firm* — Klarquist Sparkman, LLP

(57) ABSTRACT

A micromixer device has at least one fluid inlet channel and at least one fluid outlet channel. A plurality of pathways extend between the fluid inlet channel and the fluid outlet channel. The width of at least some of the plurality of pathways varies in a substantially parabolic manner along at least one dimension of the micromixer device.

13 Claims, 37 Drawing Sheets

OTHER PUBLICATIONS

El Moctar et al., "Electro-hydrodynamic micro-fluidic mixer," *Lab on a Chip*, 3:273-280, 2003.
Fournier et al., "A new parallel competing reaction system for assessing micromixing efficiency—experimental approach," *Chemical Engineering Science* 51(22):5053-5064, 1996.
Glasgow and Aubry, "Enhancement of microfluidics mixing using time pulsing," *Lab on a Chip*, 3:114-120, 2003.
Glasgow et al., "Parameters influencing pulsed flow mixing in microchannels," *Analytical Chemistry*, 76:4825-4832, 2004.
He et al., "A picoliter-volume mixer for microfluidics analytical systems," *Analytical Chemistry*, 73(9):1942-1947, 2001.
Ismagilov, "Integrated Microfluidic Systems," *Angew. Chem. Int. Ed.* 42:4130-4132, 2003.
Jongen et al., "Development of a continuous segmented flow tubular reactor and the "scale-out" concept—In search of perfect powders," *Chemical Engineering Technology*, 26(3):303-305, 2003.
Khan et al., "Microfluidic Synthesis of Colloidal Silica," *Langmuir*, 20:8604-8611, 2004.
Kockmann et al., "Silicon microstructures for high throughput mixing devices," *Microfluid Nanofluid* 2:327-335, 2006.
Krishnadasan et al., "On-line analysis of CdSe nanoparticles formation in a continuous flow chip-based microreactor," *J. Mater. Chem.* 14:2655-2660, 2004.
Li et al., "Control of crystal morphology through supersaturation ration and mixing conditions," *Journal of Crystal Growth* 304:219-224, 2007.
Liu et al., "Convergent synthesis of polyamide dendrimer using continuous flow microreactors," *Chemical Engineering Journal* 135S:S333-S337, 2008.
Mohammadi & Santiago, "Simulation and Design of Extraction and Separation Fluidic Devices," *Mathematical Modeling and Numerical Analysis* 35(3):513-523, 2001.
Moody & Collins, "Effect of Mixing on the Nucleation and Growth of Titania Particles," *Aerosol Science and Technology* 37:403-424, 2003.
Nakamura et al., "Preparation of CdSe nanocrystals in micro-flow-reactor," *Chem. Comm.* 2844-2845, 2002.
Paul & Peterson, "Microlamination for microtechnology-based energy, chemical and biological systems," *ASME International Mechanical Engineering Congress and Exposition*, Nashville, TN, AES 39:45-52, 1999.
Paul, "Micro energy and chemical systems and multi-scale fabrication," *Chapter 14 in Micromanufacturing and Nanotechnology*, Springer-Verlag, Germany, 2005.
Paul et al., "A microchemical nanofactory for the production of dendritic polymers," *Industrial Engineering Research Conference*, Orlando, FL May 20-24, 2006.
Rebrov et al., "Optimization of heat transfer characteristics, flow distribution, and reaction processing for a microstructured reactor/heat-exchanger for optimal performance in platinum catalyzed ammonia oxidation," *Chemical Engineering Journal*, 93:201-216, 2003.
Rebrov et al., "Header design for flow equalization in microstructured reactors," *American Institute of Chemical Engineers Journal* 53(1):28-38, 2007.
Richter et al., "Metallic Microreactors: Components and Integrated Systems," *Process Miniaturization; 2nd Annual International Conference on Microreaction Technology, AIChE*, 1998.
Schenk et al., "Novel liquid-flow splitting unit specifically made for numbering-up of liquid/liquid chemical microprocessing," Chemical Engineering Technology 26(12):1271-1280, 2003.
Schenk et al., "Numbering-up of micro devices: a first liquid-flow splitting unit," *Chemical Engineering Journal* 101:421-429, 2004.
Schwarzer & Peukert, "Experimental Investigation into the Influence of Mixing on Nanoparticle Precipitation," *Chem. Eng. Technol.* 25(6):657-661, 2002.
Schwarzer & Peukert, "Combined Experimental/Numerical Study on the Precipitation of nanoparticles,"*AIChE Journal* 50(12):3234-3247, 2004.
Sovran & Klomp, "Experimentally determined optimum geometries for rectilinear diffusers with rectanglular, conical or annular cross-section," *Fluid Mechanics of Internal Flow* Proceedings of a Sumposium, Warren, MI, 1965.
Taylor et al., "Scale-up methods for fast competitive chemical reactions in pipeline mixers," *Ind. Eng. Chem. Res.* 44:6095-6102, 2005.
Tonomura et al., "CFD-based optimal design of manifold in plate-fin microdevices," *Chemical Engineering Journal*, 101:397-402, 2004.
Trachsel et al., "Measurement of residence time distribution in microfluidics systems," *Chemical Engineering Science*, 60:5729-5737, 2005.
Wiessmeier & Honicke, "Strategy for the development of microchannel reactors for heterogeneously catalyzed reactions," *American Institute of Chemical Engineers*, New Orleans, USA, 1998.
Yen et al., "A continuous-flow microcapillary reactor for the preparation of a size series of CdSe nanocrystals," *Adv. Mater.* 15(21):1858-1862, 2003.
Yen et al., "A microfabricated gas—liquid segmented flow reactor for high-temperature synthesis: the case of CdSe quantum dots," *Angewandte Chemie International Edition*, 44:5447-5451, 2005.

* cited by examiner

*Improved Mixing*
*with 180° out of phase pulsing*

MICROMIXERS FOR NANOMATERIAL PRODUCTION

CROSS REFERENCE TO RELATED APPLICATION

This application claims the benefit of the earlier filing date of U.S. Provisional Patent Application No. 61/072,265, filed Mar. 28, 2008. The entire disclosure of the provisional application is considered to be part of the present disclosure and is hereby incorporated herein by reference.

ACKNOWLEDGEMENT OF GOVERNMENT SUPPORT

This invention was made with government support under W911NF-07-2-0083 awarded by the Army Research Office. The United States government has certain rights in the invention.

FIELD

The present disclosure relates generally to micromixers and methods of using micromixers to process nanomaterials.

BACKGROUND

Microchannel processing of nanomaterials can provide a number of advantages over conventional batch processing, including, for example, lower production cost, safer operation, improved selectivity, reduced energy consumption and better process control. These improvements in synthesis are largely due to the large surface-area-to-volume ratios possible within microreactor technology leading to accelerated heat and mass transport. This accelerated transport allows for rapid changes in reaction temperatures and concentrations leading to more uniform heating and mixing.

One concern in micromixer design is the non-uniform velocity profile due to laminar flow which leads to variations in shear-dependent mixing and a broadening of the residence time distribution (RTD) of molecules within the channel. Velocity profiles become even more difficult to manage as the design is scaled up through "numbering up" strategies that combine multiple microchannel structures together. Another concern in micromixer design is clogging. The size and shape of current microchannel structures are prone to undesirable clogging.

SUMMARY

The foregoing and other objects, features, and advantages of the embodiments described herein will become more apparent from the following detailed description, which proceeds with reference to the accompanying figures.

In a first embodiment, a micromixer device comprises at least one fluid inlet channel and at least one fluid outlet channel. A plurality of pathways are positioned between the fluid inlet channel and the fluid outlet channel. The width of at least some of the plurality of pathways vary in a substantially parabolic manner along at least one dimension of the micromixer device.

In a specific implementation, the fluid inlet channel is located at a substantially central location relative to the plurality of pathways and the width of the pathways varies in a substantially parabolic manner as a function of the distance of the pathway from the fluid inlet channel. In another specific implementation, a plurality of structural elements define the pathways. The structural elements can comprise channel walls that are substantially rectangular in shape.

In other specific implementations, the device comprises a plurality of sections. Each section comprises a plurality of pathways that have substantially the same width. The width of pathways varies from section to section in a substantially parabolic manner. The device can also comprise a base portion and two side walls that at least generally converge towards one another, and the fluid inlet channel can be located substantially at the intersection of the two converging side walls.

In other specific implementations, the location of the fluid inlet channel can define a central longitudinal axis of the device, and the lengths of the pathways can vary according to their distance from the longitudinal axis. The lengths of the pathways nearest the longitudinal inlet channel can be longer than the lengths of the pathways furthest from the inlet channel. The structural elements can be pillars that are substantially cylindrical and which vary in width.

In another embodiment, a microchannel array comprises a plurality of laminae. Each lamina comprises at least one micromixer device that has a plurality of fluid flow pathways between an inlet region and an outlet region. The inlet region of the micromixer device can be located substantially along a central longitudinal axis of the micromixer device, and the fluid flow pathways can vary in length and width relative to their distance from the central longitudinal axis.

In specific implementations, the width of the fluid flow pathways can vary substantially parabolically relative to their distance from the central longitudinal axis. In specific implementations, there are at least four laminae and at least four micromixer devices on each of the laminae. In specific implementations, the lengths of the fluid flow pathways are shorter the further they are from the central longitudinal axis and the widths of the fluid flow pathways are wider the further they are from the central longitudinal axis. Each micromixer device can comprise a plurality of sections, with each section comprising a plurality of fluid flow pathways that have substantially the same width. The widths of pathways can vary from section to section in a substantially parabolic manner. The fluid flow pathways can be made using any suitable process, such as chemical etching.

In another embodiment, a microchannel mixer comprises a first fluid inlet for introducing a first fluid into the mixer; a second fluid inlet for introducing a second fluid into the mixer; a serpentine fluid flow pathway; a first pump device, the first pump device being configured to introduce the first fluid into the fluid flow pathway; and a second pump device, the second pump device being configured to introduce the second fluid into the fluid flow pathway. The first and second pump devices can be configured to pump the first and second fluids, respectively, into the fluid flow pathway using reverse oscillatory flow.

In specific embodiments, the first and second pump devices both comprise two pump members. A first pump member is configured for forward sinusoidal flow and a second pump member is configured for reverse sinusoidal flow. In other specific implementations, the first and second pump devices are configured to pump the first and second fluids, respectively, into the fluid flow pathway at 180 degrees out of phase with each other.

In other specific implementations, the fluid flow pathway is machined to be about 200 micrometers or greater in width. The serpentine fluid flow pathway can be defined by a top and bottom member. The serpentine fluid flow pathway can be machined into the top and bottom members. The top and bottom members can be removably coupled together. In another specific embodiment, the standard deviation of mass fraction at an outlet of the serpentine fluid flow pathway is less than about 0.06.

BRIEF DESCRIPTION OF THE DRAWINGS

FIG. 7(*b*) shows a micromixer with a parabolic variation in pillar diameter.

FIG. 8(*b*) shows a velocity profile distribution for the micromixer shown in FIG. 7(*b*).

FIG. 16(*b*) illustrates a velocity profile for a micromixer having a slope factor of c=0.04.

DETAILED DESCRIPTION

Figure 1:
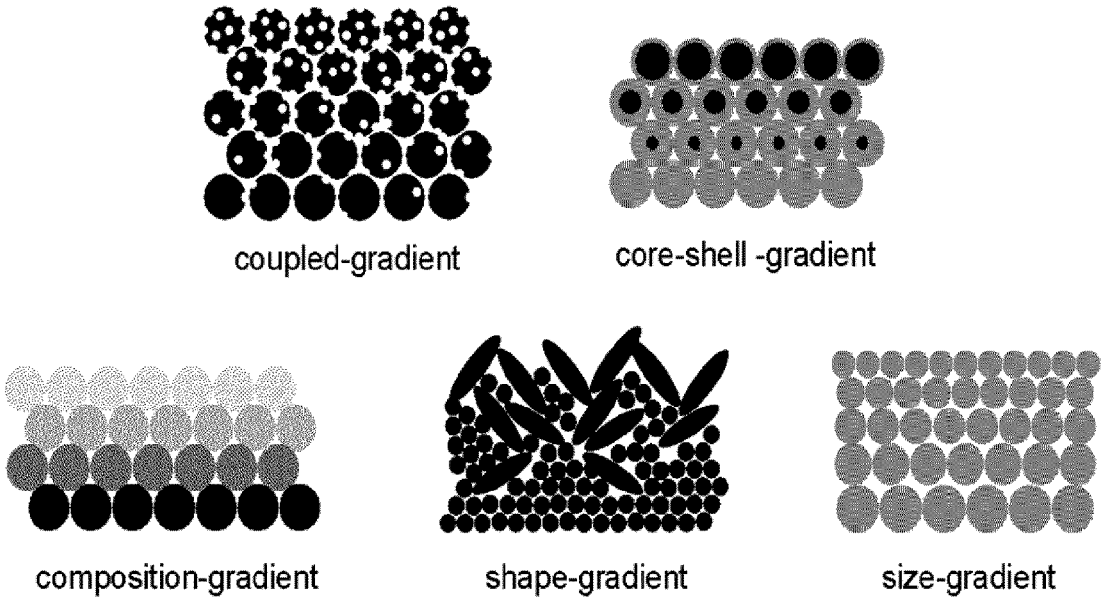
FIG. 1 is a schematic drawing illustrating embodiments of hierarchical nanostructures that can be made using embodiments of disclosed micromixers.

The following description is exemplary in nature and is not intended to limit the scope, applicability, or configuration of the invention in any way. Various changes to the described embodiment may be made in the function and arrangement of the elements described herein without departing from the scope of the invention.

As used in this application and in the claims, the singular forms "a," "an," and "the" include the plural forms unless the context clearly dictates otherwise. Additionally, the terms "having" and "including" mean "comprising." Further, the terms "coupled" and "associated" generally means electrically, electromagnetically, and/or physically (e.g., mechanically or chemically) coupled or linked and does not exclude the presence of intermediate elements between the coupled or associated items. For the purposes of this disclosure, nanomaterials refer to applications with features smaller than about one tenth of a micrometer in at least one dimension.

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to and/or combined with any other description or disclosure provided herein relating to alternative or different embodiments.

Moreover, for the sake of simplicity, the attached figures may not show the various ways (readily discernable, based on this disclosure, by one of ordinary skill in the art) in which the disclosed system, method, and apparatus can be used in combination with other systems, methods, and apparatuses. Additionally, the description sometimes uses terms such as "produce" and "provide" to describe the disclosed method. These terms are high-level abstractions of the actual operations that can be performed. The actual operations that correspond to these terms can vary depending on the particular implementation and are, based on this disclosure, readily discernible by one of ordinary skill in the art.

Various embodiments of interdigital micromixers are described herein. Such micromixers are capable of scaling up liquid-phase nanosynthesis. By providing a uniform velocity profile, more uniform mixing and more uniform RTD can be achieved. Application of the embodiments disclosed herein to higher temperature liquid phase and gas phase reactions can be accomplished by incorporating integrated microchannel heat exchangers.

In nanoparticle synthesis, microreactor technology offers large surface-area-to-volume ratios within microchannel structures to accelerate heat and mass transport. This accelerated transport allows for rapid changes in reaction temperatures and concentrations leading to more uniform heating and mixing. Consequently, microreactors can provide dramatic reductions in the dispersity of quantum dot size distributions. The following references, the entire disclosures of which are incorporated herein by reference, disclose micromixers and/or microreactor technology: U.S. patent application Ser. No. 09/369,679, filed Aug. 5, 1999 and issued as U.S. Pat. No. 6,793,831 on Sep. 21, 2004, titled MICROLAMINATION METHOD FOR MAKING DEVICES; U.S. Provisional Patent Application No. 60/253,383, filed Nov. 28, 2000, titled METHOD AND APPARATUS FOR MAKING MONOLITHIC INTERMETALLIC STRUCTURES AND INTERMETALLIC DEVICES MADE THEREBY; U.S. patent application Ser. No. 09/996,621, filed Nov. 28, 2001 and issued as U.S. Pat. No. 6,672,502 on Jan. 6, 2004, titled METHOD FOR MAKIN DEVICES HAVING INTERMETALLIC STRUCTURES AND INTERMETALLIC DEVICES MADE THEREBY; International Patent Application No. PCT/US2004/03452, filed Oct. 25, 2004, titled HIGH VOLUME MICROLAMINATION PRODUCTION OF DEVICES; U.S. patent application Ser. No. 11/086,074, filed Mar. 21, 2005 and issued as U.S. Pat. No. 7,507,380 on Mar. 24, 2009, titled MICROCHEMICAL NANOFACTORIES; and U.S. patent application Ser. No. 11/897,998, filed Aug. 31, 2007, titled MICROCHEMICAL NANOFACTORIES.

Microreactors can also improve cycle times and yields associated with the production of precision macromolecules, such as dendrimers. Further, microreactor technology can minimize the environmental impact of hierarchical manufacturing through solvent-free mixing, integrated separation techniques, and reagent recycling. Finally, the possibility of synthesizing nanomaterials in the required volumes at the point-of-deposition eliminates the need to store and transport potentially hazardous materials while providing new opportunities for tailoring novel, functionally gradient structures. For example, microreactor technology can be used to form coupled-gradient, core-shell-gradient, composition-gradient, shape-gradient, and size-gradient structures such as those shown in FIG. 1.

To improve and establish the industrial viability of microchannel processing of nanomaterials, it is desirable to establish that parallel microchannels can be scaled-up with each microchannel processing equivalent amounts of fluid under precise concentrations and temperatures and with small residence time distributions. Accordingly, improvements in the scale-up issues associated with the microchannel processing of nanomaterials are desirable.

Scale-up fundamentally involves increasing the volumetric flow rate through the microreaction system according to the equation:

$$\dot{v}=V_{avg}\cdot A \tag{1}$$

where $\dot{v}$ is the volumetric flow rate of reactants through microchannels, $V_{avg}$ is the average velocity of the reactants through the microchannels and A is the flow cross-section, which is a product of the flow cross-section of each microchannel by the number of microchannels. Increasing the average velocity through the microchannels increases the pressure drop across the microchannel, which is practically limited by the size of the pump. A more reasonable strategy involves increasing the cross-section of flow. Given that the flow in microchannel technology is predominately laminar and therefore the size of the channel is generally constrained by the application (e.g., the speed of heat transfer or diffusional mixing), microchannel scale-up requires a strategy for arraying parallel microchannels. In the general microreactor literature, this scale-up strategy is sometimes called "numbering up." As used herein, scale-up is intended to refer to be the processing of an industrially relevant flow rate sustained by an array of parallel microchannels.

At least three levels (or different types) of numbering-up can be considered for increasing the flow cross-section of microchannel architectures: "device up," "layer up," and "channel up" structures. "Device up" structures generally include identical devices that are connected in parallel with interconnects. "Layer up" structures generally include identical layers or laminae that are stacked and/or coupled (e.g., bonded) together. "Channel up" structures generally include identical channels that are arrayed on a single lamina "Channel up" is the most fundamental level of scale-up and typically involves arraying identical channels within a confined material layer or lamina. Ultimately, this strategy is generally constrained by the size of the microchannel and the size of the lamina used. Manufacturing processes are typically limited in the size of the laminae that can be processed and so impose the ultimate constraint on channel-up strategies. Additional channels can be added using a "layer up" strategy where additional laminae are added, with each lamina containing, for example, identical channel-up arrays. The constraint on this strategy is typically the thickness of the laminae and the work envelope of the bonding process used to convert the laminae into a monolithic structure.

Figure 2:
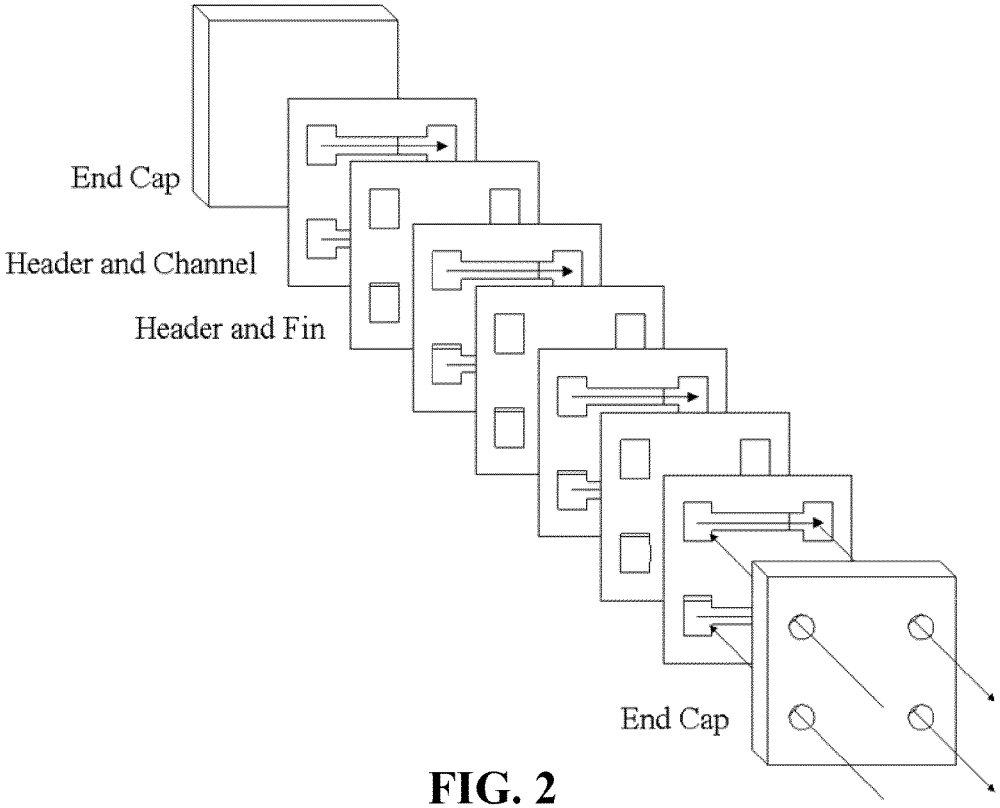
FIG. 2 is a microlamination architecture that can be used to fabricate a dual micro-channel array.

As shown in FIG. 2, microlamination architectures, involving the patterning and bonding of thin laminae, employ at least these two strategies for scaling-up microchannel arrays. FIG. 2 illustrates both channel-up and layer-up strategies, with arrows illustrating the direction of flow. Beyond this, a "device up" strategy can be used to further increase throughput by adding identical devices in parallel.

These scale-up strategies, however, have various difficulties and/or undesirable effects. One undesirable effect of a parallel microchannel reaction architecture is a variation in reaction conditions. Variations in concentration, temperature and residence time can all be detrimental to nanoparticle size distributions. One of the more difficult elements to control is residence time. Poor residence time distributions can be due to both flow velocity profiles within microchannels, as well as flow maldistribution between microchannels.

For the large class of homogeneous liquid-phase reactions, microreactors are frequently based on single-phase laminar flow designs. However, such designs can be restricted in terms of large residence time distributions (RTDs). Yen et al. showed progress toward improving RTDs by using recirculation within two-phase segmented flows (gas-liquid or liquid-liquid) to eliminate axial dispersion as encountered in single phase laminar flow. (See Yen, B. K. H., Gunther, A., Schmidt, M. A., Jensen, K. F. and Bawendi, M. G., (2005), "A microfabricated gas-liquid segmented flow reactor for high-temperature synthesis: the case of CdSe quantum dots," Angewandte Chemie International Edition, Vol. 44, pp. 5447-5451.) Jongen et al. has precipitated out $CaCO_3$ using segmented flow microreactor and established that the particle size distribution is narrower than the commercially available powders. (See Jongen, N., Donnet, M., Bowen, P., Lemaître, J., Hofmann, H., Schenk, R., Hofmann, C., Aoun-Habbache, M., Guillemet-Fritsch, M., Sarrias, J., Rousset, A., Viviani, M., Buscaglia, M. T., Buscaglia, V., Nanni, P., Testino, A. and Herguijuela, J. R., (2003), "Development of a continuous segmented flow tubular reactor and the "scale-out" concept—In search of perfect powders," Chemical Engineering Technology, Vol. 26(3), pp. 303-305.) The span is reduced from 1.69 to 1.09. The experiments were also conducted with $BaTiO_3$. The produced powder had a much smaller particle size (30 nm) with a high specific surface area (40 $m^2/g$) compared to commercially available high purity fine powder having particle size (60 nm) with specific surface area of 17 $m^2/g$. Recirculation has the dual effect of narrowing the RTD as well as improving mixing. In contrast to single-phase designs, segmentation makes it possible to drive reactions to required yields over significantly shorter times owing to the enhanced mixing, while maintaining narrow RTDs and producing monodispersed powder particles.

However, this condition is strictly true only if neighboring slugs of the phase of interest are completely disconnected from each other. Therefore, in designing microchannel reactors, it can be helpful to minimize sharp changes in flow direction. Using a segmented gas-liquid flow system, Trachsel et al. found, in maneuvering around sharp radii, adjacent liquid slugs are connected across thin liquid films or menisci. (See Trachsel, F., Günther, A., Khan, S. and Jensen, K. F., (2005), "Measurement of residence time distribution in microfluidic systems," Chemical Engineering Science, Vol. 60, pp. 5729-5737.) Khan et al. has compared the single phase laminar flow reactor (LFR) with a segmented flow reactor (SFR) for producing silica nanoparticles. (See Khan, S. A., Gunther, A., Schmidt, M. A. and Jensen, K. F., (2004), "Microfluidic Synthesis of Colloidal Silica," Langmuir, Vol. 20, pp. 8604-8611.) The results showed that the latter one has smaller particle size distribution compared to continuous single phase microreactor (LFR: residence time: 6.5 min, average particle size: 281 nm with a standard deviation of 20%; SFR: residence time: 10 min, average particle size: 277 nm with a standard deviation of 9.5%). The thickness of the film depends on the relative magnitude of viscous to surface tension forces using the dimensionless capillary number, $C_a$:

$$C_a = \frac{\mu U_b}{\sigma} \tag{2}$$

where $\mu$ is the liquid viscosity, $U_b$ is bubble velocity and $\sigma$ is the interfacial tension. Based on Betterton's model, it was predicted that rectangular channels would have an increase of approximately two to three times increase in the communication between neighboring liquid slugs than circular channels with the same cross-sectional area. Other techniques to introduce segmented (slug) flow inside a microchannel system are typically based on the application of external fields like pneumatically, magnetically, ultrasonically, or electrically applied external fields.

It is desirable to improve the equalization of flow distributions across microchannel arrays. This can be particularly true in the field of nanomaterial synthesis. In addition to effecting residence time distributions, fluid velocities across microchannels affect the heat and mass transfer throughout the device. To equilibrate flow velocities, an appropriate "channel-up" structure preferably distributes the flow from a common reactant reservoir through the microchannels to a common product reservoir. Amador et al. studied two different kinds of manifold structures, namely consecutive and bifurcated, using a method based on electrical resistance circuit analysis and validated against finite element simulations. (See Amador, C., Gavriilidis, A. and Angeli, P., (2004), "Flow distribution in different microreactor scale-out geometries and the effect of manufacturing tolerances and channel blockage," Chemical Engineering Journal, Vol. 101, pp. 379-390.) An analytical model was also developed to study the effects of manufacturing tolerances and of channel blockage on flow distribution. The bifurcated manifold structure can provide better uniform flow distribution. Commenge et al. evaluated flow distribution in a multichannel microreactor having a consecutive type of manifold structure to distribute the reactant fluid to the microchannels. (See Commenge, J. M., Falk, L., Corriou, J. P. and Matlosz, M., (2002), "Optimal design for flow uniformity in microchannel reactors," American Institute of Chemical Engineers Journal, Vol. 48(2), pp. 345-348.) A reactor design was found for a single-phase flow distribution that provided a more uniform flow distribution. The analysis was performed using a resistance network method combined with an optimizing function to calculate varying diameters for flow distributing and collecting channels.

Bejan et al. compared the fractal tree-like structure to naturally available structures like lungs, arteries, veins etc and found that these structures not only provided flow uniformity but also minimized flow resistance through a volume-to-point path. (See Bejan, A. and Errera, M. R., (1997), "Deterministic tree networks for fluid flow: geometry for minimal flow resistance between a volume and one point," Fractals, Vol. 5 pp. 685-695.) Ajmera et al. developed a novel design of a silicon cross-flow microreactor for parallel testing of porous catalyst beds. (See Ajmera, S. K., Delattre, C., Schmidt, M. A., and Jensen, K. F., (2002), "Microfabricated differential reactor for heterogeneous gas phase catalyst testing," Journal Catalysts, Vol. 209, pp. 401-412.) A more uniform flow distribution was achieved by bifurcating the inlet stream into 64 parallel microchannels. The experimental data was validated using computational fluid dynamics (CFD) models.

Uniformity of the flow distribution, however, preferably also involves equalizing and distributing flow between layers and devices. At a device level, the non-uniformity of fluid flow in a microchannel reactor system is primarily attributed to the difficulty in making a smooth transition from the cross sectional shape of a reactor to that of the upstream and downstream connectors without any dead volume. At a layer level, the methods for uniformly distributing fluid within multilayered structures can vary based on differences in the geometry of the inlets and the outlets of the reactor units. Baffles can be used to create a backpressure upstream of the array. Screens have been found to be a simple and effective means to distribute the flow uniformly throughout the cross section of macro-scale reactors. Several researchers have evaluated the use of different kinds of meshes and screens for solving the problem of flow equilization between microchannel layers. The screen leveling properties depend on the geometrical parameters like effective (open) cross-section and the thickness of the screen. The drag co-efficient, ζ, of the screen can be defined as $$\zeta = \frac{2\Delta p}{\rho \cdot V_{avg}^2} \tag{3}$$

where Δp is pressure drop along the screen, ρ is the density of the fluid and $V_{avg}$ is the average velocity. A flow distribution system is suggested if ζ of the screen is less than 1000. Riman et al. proposed a method for calculating the distortion in velocity profile using a similar grid concept. Most of these methods have been developed for macro-scale reactors under turbulent flow regimes having high Reynolds number, which is not the case in microreactor systems. However, Rebrove et al. proposed a conical diffuser connected to a thick-walled screen to enhance the uniformity of fluid flow distribution within micro-scale reactors. (See Rebrov, E. V., Duinkerke, S. A. and Schouten, J. C., (2003), "Optimization of heat transfer characteristics, flow distribution, and reaction processing for a microstructured reactor/heat-exchanger for optimal performance in platinum catalyzed ammonia oxidation," Chemical Engineering Journal, Vol. 93, pp. 201-216; and Mies, M. J. M., Rebrov, DeCroon, M. H. J. M., Schouten, J. C. and Ismagilov, I. Z., (2006), "Inlet Section for Micro-Reactor," Patent PCT/NL2006/050074; 2006.) The design of the header was optimized using CFD simulations. Numerical simulations suggested that the proposed header configuration including screens can effectively improve the performance of the microreactor, decreasing the ratio of the maximum velocity to the mean flow velocity to between 1 and 2 for a wide range of Reynolds numbers (e.g., 0.5-10).

Figure 3:
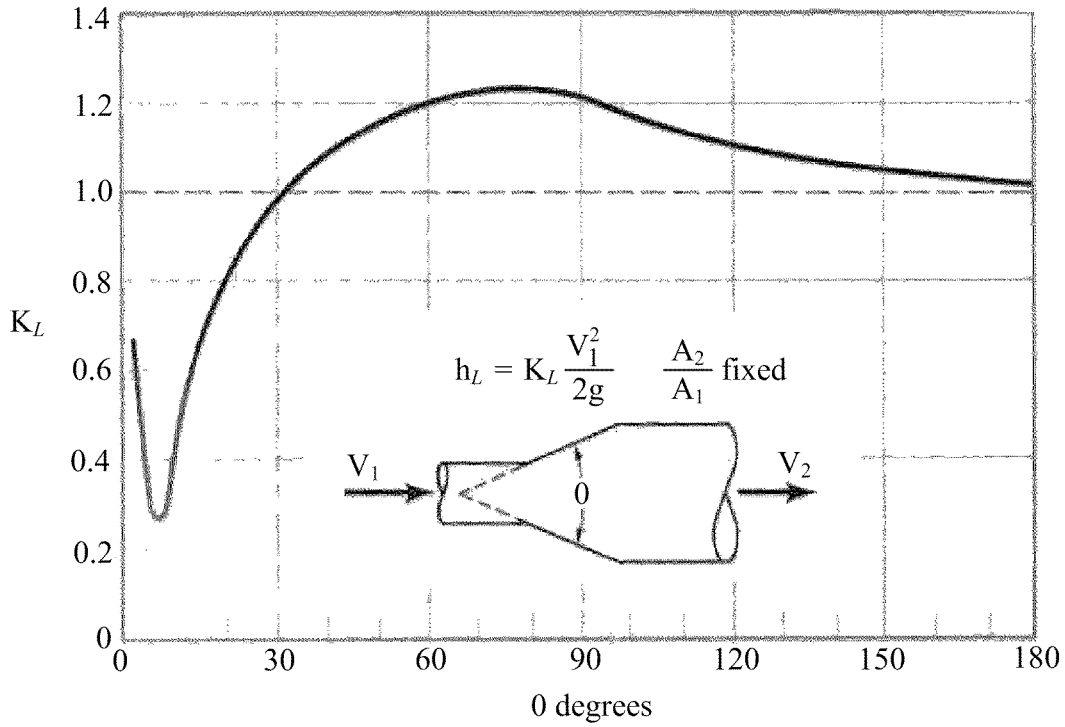
FIG. 3 illustrates as loss co-efficient $K_L$ for a typical conical diffuser.

The head loss associated with a flow through an interconnect-header interface is a common minor loss. The purpose of a header is to regulate the flow distribution by changing the geometry of the system. The most common method to determine these head losses or pressure drop is to specify a loss factor, $K_L$ $$K_L = \frac{h_L}{(V_{avg}^2/2g)} = \frac{2\Delta p}{\rho \cdot V_{avg}^2} \tag{4}$$

where $h_L$ is the head loss between sections having areas $A_1$ (inlet) and $A_2$ (outlet), $V_{avg}$ is the average velocity of the fluid, Δp is the pressure drop and ρ is the density of the fluid. $K_L$ is a function of geometry of the component and Reynolds number, $R_e$. A fluid may flow from a reservoir into a pipe through any number of different shaped entrance regions, namely square, round, conical (downstream) or vice versa (upstream). As a fluid enters into a square-edged entrance, there is vena contracta (which results in a dead volume region because of contraction or expansion) developed because the fluid cannot make a sharp right-angled corner. At the vena contracta region, the kinetic energy of the fluid is partially lost because of viscous dissipation and an entrance or exit head loss is generated. For a micromixer, this vena contracta on the outlet side can significantly affect the flow distribution. Conical diffusers, with varying area ratios, $A_1/A_2$, can be used to better regulate the flow distribution. FIG. 3 shows a loss co-efficient $K_L$ for a typical conical diffuser, including the effect of the included angle of the diffuser, θ, on the velocity head through an expansion which is the typical situation for a microreactor outlet. Sovran et al. reported that the optimum angle for minimum loss co-efficient under these conditions is θ=8°. (See Sovran, G. and Klomp, E. D., (1967) "Experimentally determined optimum geometries for rectilinear diffusers with rectanglular, conical or annular cross-section," Fluid Mechanics of Internal Flow, Elsevier, Amsterdam.)

Generally, mixing within microchannel reactors is rapid enough for most liquid-phase nanoparticle reactions. Even under simple diffusive conditions, mixing times well below one second have been reported. Some attempts have been made to improve upon these conditions. Burke and Regnier used a series of "short cut" tributaries to promote mixing inside a microreactor. (See He, B., Burke, B. J., Zhang, X., Zhang, R. and Regnier, F. E., (2001), "A picoliter-volume mixer for microfluidic analytical systems," Analytical Chemistry, Vol. 73(9), pp. 1942-1947.) Enhancement in mixing has also been investigated by introducing time pulsed cross flows into the main stream flowing in a channel. Efforts have been made to study the effect of varying the timing of lateral pulses with respect to the flow rate inside the main fluid stream on the mixing quality. (See Moctar, A. O. E., Aubry, N. and Batton, J., (2003), Electro-hydrodynamic micro-fluidic mixer, *Lab on Chip*, Vol. 3, pp. 273-280.) Glasow et al. examined the mixing of two reagents by simply varying the inlet stream flow rates without using any additional geometric features, parts or external fields. (See Glasgow, I., Lieber, S. and Aubry, N., (2004), Parameters influencing pulsed flow mixing in microchannels, *Analytical Chemistry*, Vol. 76, pp.4825-4832.)

Figure 4:
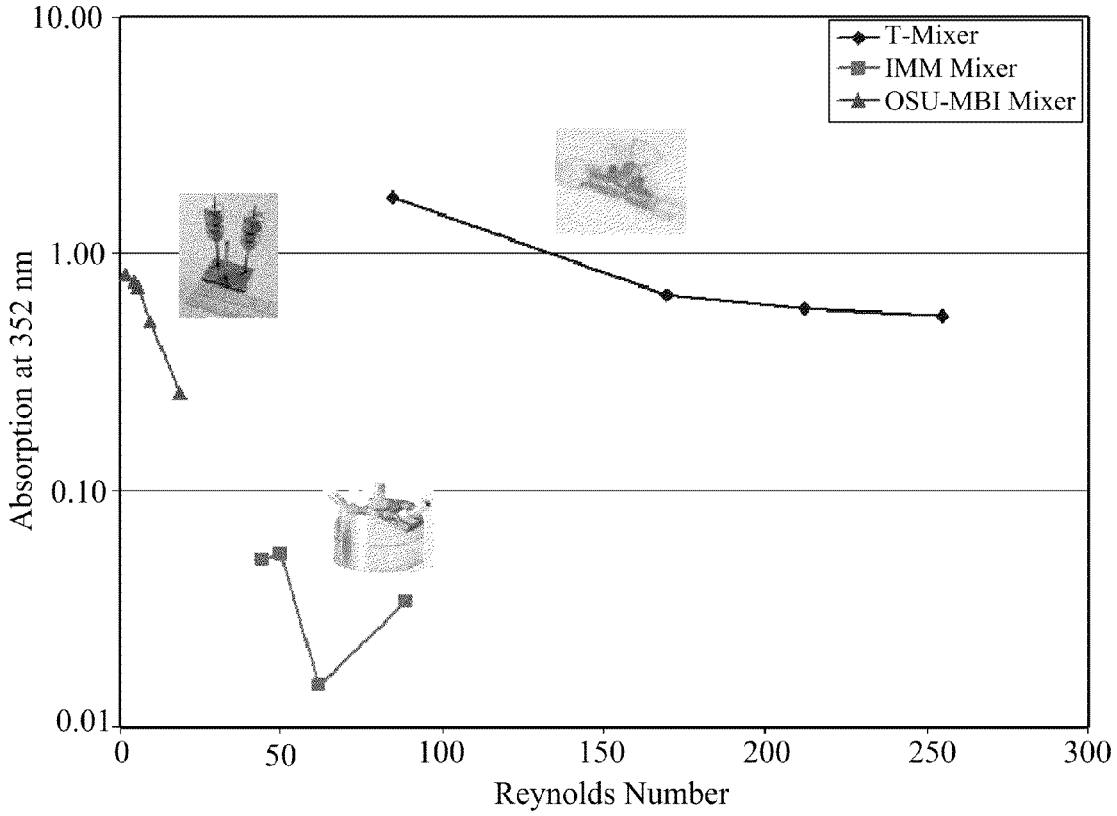
FIG. 4 shows absorption data for several types of micromixers having a flow rate dependence.

Generally, as average velocity increases within an interdigital micromixer, mixing performance improves. FIG. 4 illustrates data for a standard test reaction used to qualify mixing quality. The Y-axis of FIG. 4 is a measure of mixing efficiency based on the amount of side product produced in a competing reaction. Absorption data indicates the amount of secondary (unpreferred) product. The improved mixing quality is likely due to increased shear between interdigitated flow lamella and velocity distribution is likely not only important for residence time distribution, but also for uniform mixing.

Commenge et. al (2002) proposed an approximate pressure drop model based on division of a mixer into a series of rectangular ducts. (See Commenge, J. M., Falk, L., Corriou, J. P., Matlosz, M., "Optimal Design for Flow Uniformity in Microchannel Reactors," AIChE Journal February 2002 Vol. 48 no.2 345-358.) The channel widths remain constant while the taper of the inlet chamber is varied based on the model. The model was applied to optimizing a 26-channel mixer inlet chamber shape described by 26 sectional widths. The resulting geometry was nearly linear but with slight curvatures adding complexity. This complex shape, however, is difficult to manufacture. Linear variation of the chamber inlet taper was determined to be inadequate for achieving a uniform velocity profile but was deemed sufficient for practical applications.

Tonomura et. al (2003) used CFD analyses to confirm that flow uniformity among microchannels depends on the manifold shape. (See Tonomura, O., Tanaka, S., Noda, M., Kano, M., Hasebe, S., Hashimoto, I., "CFD-based optimal design of manifold in plate-fin microdevices", Chemical Engineering Journal 101 (2004) 397-402.) A CFD-based optimization method was proposed. They first demonstrated how flow uniformity is improved by increasing the length of the channels. All channels were the same length and all other variables were held constant. Another investigation demonstrated that expansion of the outlet manifold could improve flow uniformity. They further demonstrated how introducing a taper into the outlet manifold region can improve flow uniformity. An automated optimization using CFD was performed using a single variable defining outlet region taper angle. Tonomura et al. stated that combining their work with that of Commenge et. al in a sequential optimization process is promising.

The methods of Commenge et al. and Tonomura et al., however, do not allow a large manifold region using the manufacturing process described herein. That process requires, for structural integrity, that the micromixer does not contain an etched feature larger than 300 μm in width. If these models discussed above were applied to the processes and designs disclosed herein the total size of the mixer would be impractically small.

Richter et al. (1998) used CFD to design a gas phase microreactor with concentric radial channels of equal volumetric flow rate. (See Richter T., Ehrfeld W., Gebauer K., Golbig K., Hessel V., Lowe H., Wolf A., "Metallic Micfroreacors: Components and Integrated Systems", Process Miniaturization; 2nd Annual International Conference on Microreaction Technology, AIChE, 1998.) Curved channels were introduced to improve mixing performance. Channel length increased with radius of path and, to compensate for this, outer channels were wider than inner channels. The flow velocity of the shortest compared to the longest channels was faster by a factor of about ten. While the volumetric flow rate across the flow channels is uniform, the residence time is highly non-uniform.

Figure 5:
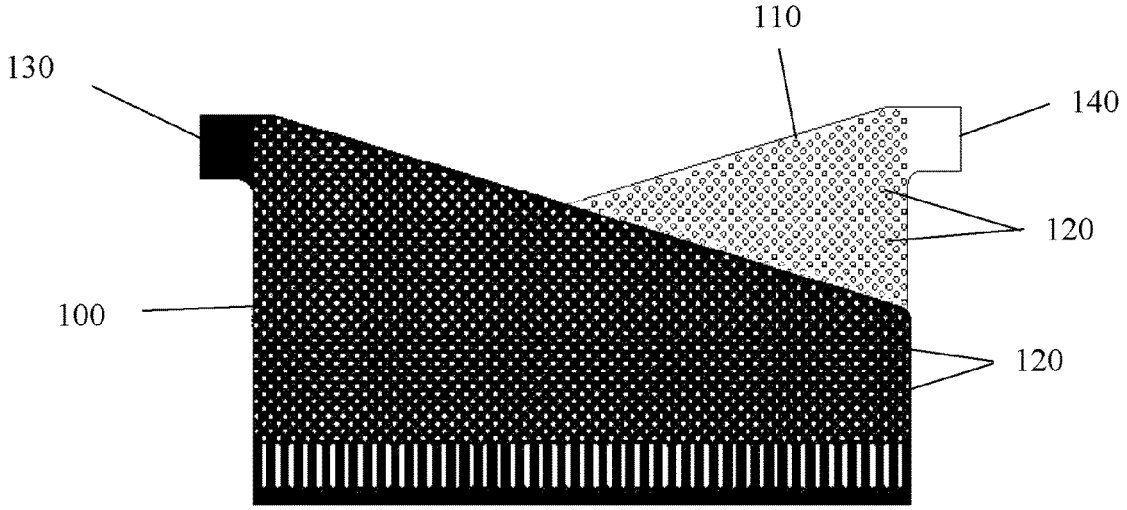
FIG. 5 illustrates a micromixer with cylindrical pillars. The outlined geometry illustrates an adjacent bonded lamina.
Figure 6:
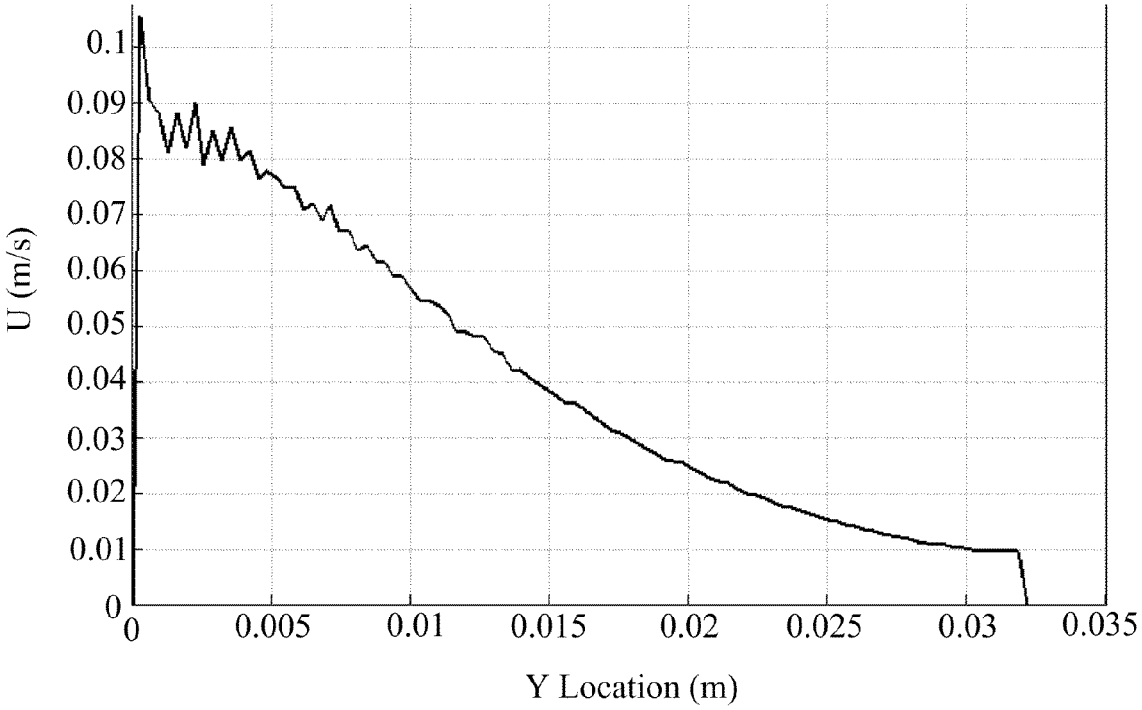
FIG. 6 illustrates the velocity profile of the micromixer model shown in FIG. 5.

The lamina chemical etching process defines a minimum feature size, and the mechanical bonding process defines a maximum allowable distance between mechanical supports. Mechanical supports must be aligned layer to mirrored layer. In the embodiment shown in FIG. 5, two adjacent bonded layers 100, 110 are shown. Layer 100 has an inlet region 130 and layer 120 has an inlet region 140. Cylindrical support pillars 120 (shown as white dots on layer 100 and as circles on layer 110) were placed throughout the tapered manifold region to provide support and encourage flow dispersion. The velocity distribution of this design, calculated by a three-dimensional CFD analysis and shown in FIG. 6, was highly nonuniform.

Figures 7, 7A, 7B:
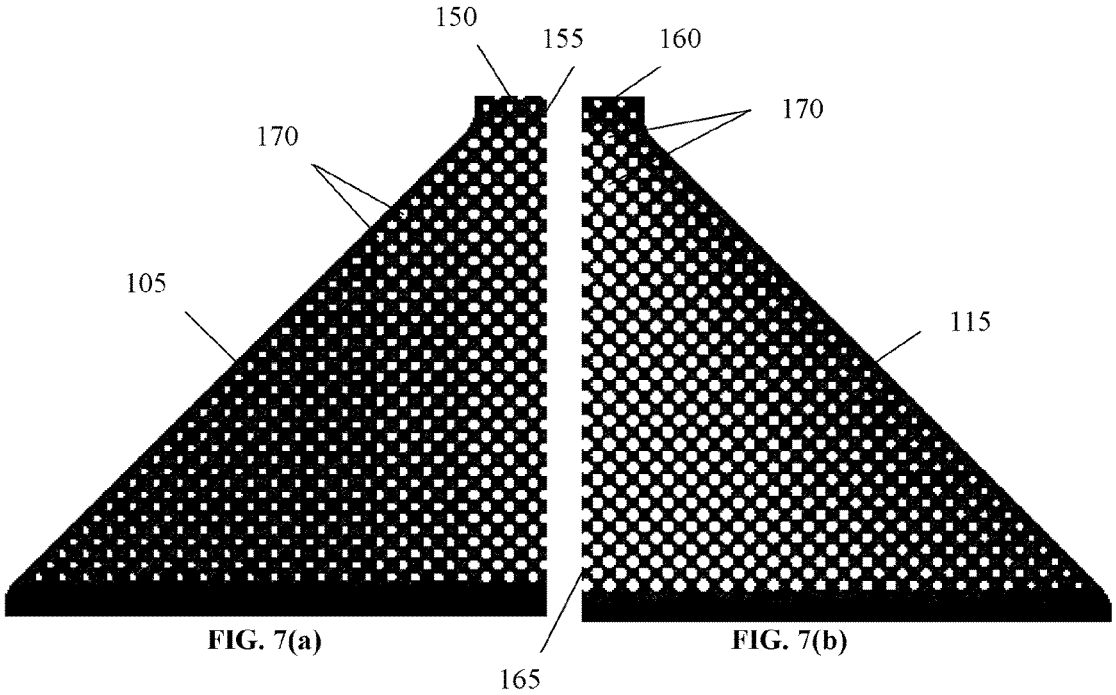
FIG. 7(*a*) shows a micromixer with a linear variation in pillar diameter.

By introducing the inlet flow in the center of the mixer, instead of from the side, there is less flow nonuniformity to counteract. Referring to FIGS. 7(*a*) and 7(*b*), two portions 105, 115 of a micromixer channel are shown. Portions 105, 115 are formed with inlet regions 150, 160 in a center of the respective micromixer channel. Pillars 170 are spaced apart throughout both portions 105, 115. For convenience, FIGS. 7(*a*) and 7(*b*) each illustrate half of a micromixer channel, with the other half of the micromixer channel being a mirror image taken from the centers 155, 165 of the portions shown. Because the geometry in these embodiments is symmetric about the mixer centerline, more options are available for pillar sizing and placement while still adhering to alignment constraints. Pillar diameter can be adjusted so that those pillars further from the center are reduced in diameter relative to the pillars closer to the center, which increases flow area and thereby reduces pressure drop across the micromixer.

Figure 8A:
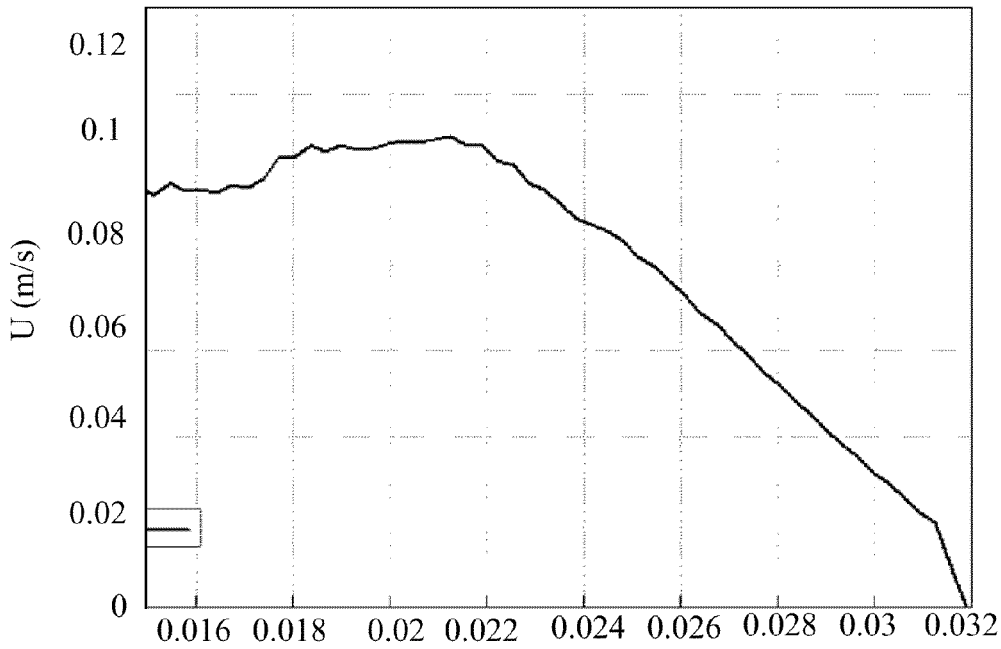
FIG. 8(*a*) shows a velocity profile distribution for the micromixer shown in FIG. 7(*a*).
Figure 8B:
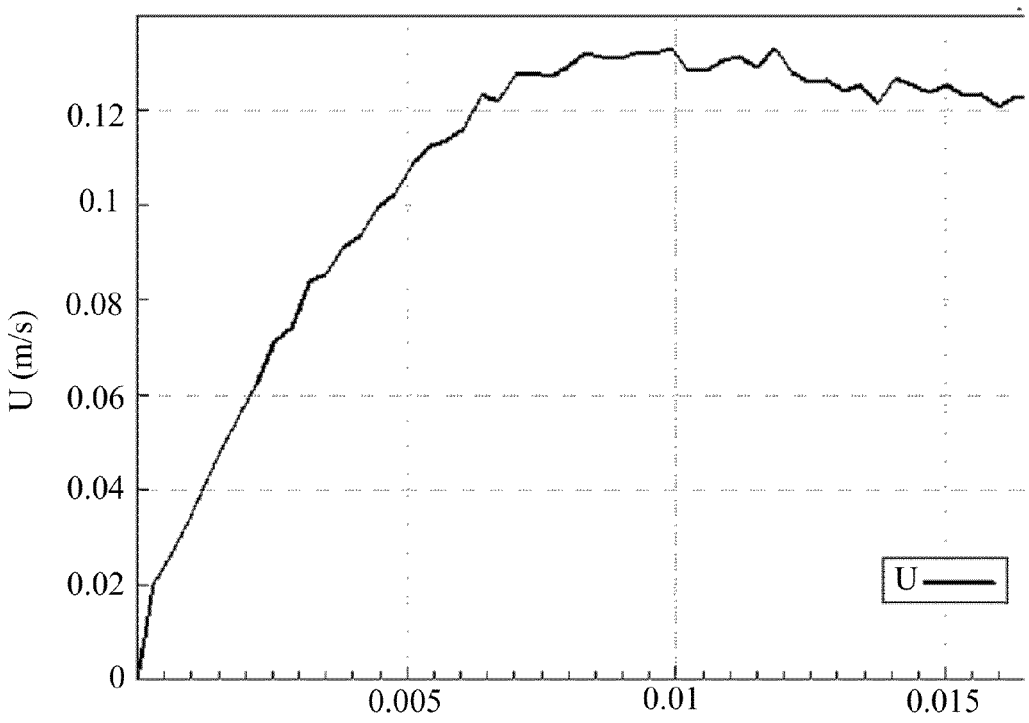

In portion 105, the pillar diameter varies linearly across the width of the mixer. Each half of the micromixer portion 105 was divided into four sections corresponding to four different pillar diameters. Thus, as shown in FIG. 7(*a*), micromixer portion 105 has pillars 170 of four different sizes, which vary based on the distance from the center 155 of the micromixer portion 105. As shown in FIG. 8(*a*), the resulting velocity profile indicated that flow resistance should be desirably reduced in the outer regions.

In the next embodiment illustrated by FIG. 7(*b*) pillar diameter varies as a function of distance from mixer centerline according to the following equation:

$$d_{max} - \left(\frac{x}{L}\right)^2 * (d_{max} - d_{min}) \tag{5}$$

where $d_{min}$ and $d_{max}$ are the minimum and maximum pillar diameters, x is the distance from the centerline of the mixer, and L is the total width of the micromixer. Thus, the micromixer shown in FIG. 8(*b*) has pillars that vary in size (e.g., in diameter) parabolically. In addition, it was determined that parabolic variations in the size of the pillars provides improved flow uniformity. If desired, the plurality of sections described above with respect to linear variation of pillar size can also be used with parabolic variation in size. In such an embodiment, the size of the pillars would still vary in a substantially parabolic manner, even though adjacent pillars may be the same size.

Figure 9:
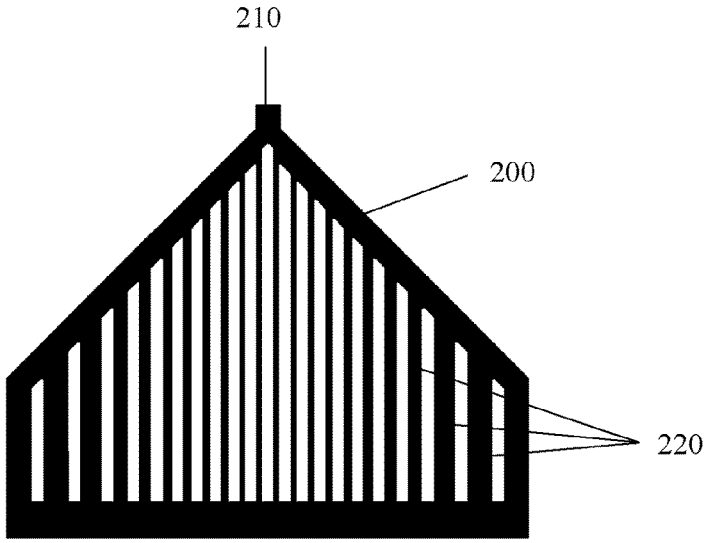
FIG. 9 illustrates a micromixer channel width that varies according to a parabolic function.

In another embodiment, a micromixer design with even further improved flow uniformity and simpler geometry is provided. As shown in FIG. 9, a micromixer 200 comprises an inlet region 210 and a plurality of channel members 220. The micromixer 200 preferably comprises channels 220 of varying width along at least one dimension of the micromixer (e.g., along the width of the micromixer). For a fixed channel height, the channel width preferably varies across the width of the micromixer according to the parabolic function:

$$\text{channelwidth} = cx^2 + w_{min} \tag{6}$$

where c is a slope constant, x is the distance from the centerline of the mixer, and $w_{min}$ is the minimum channel width defined by manufacturing constraints. Accordingly, the width of the channels vary substantially parabolically, similarly to the variation of pillar diameter disclosed in the previous embodiment.

Channels of increasing width can be formed in the micromixer 200 until the maximum desired channel width is reached. In one embodiment, the channel width of the micromixer varies as a function of distance from the center of the micromixer using c=0.040 (e.g., as shown in FIG. 9). The minimum and maximum allowable channel widths thus define the total number of channels and total mixer width.

If desired, the micromixer can be formed with a plurality of sections, with the width of the channels (pathways) in each section being substantially the same. Adjacent sections, however, can have channels of different widths, with the widths varying parabolically from one another. Forming sections in this manner can simplify construction since one or more pathways (channels) are constructed with the same width.

The inlet region 210 is desirably positioned at a central longitudinal axis of the micromixer 200, as shown in FIG. 9. In other words, the inlet region 210 is located at one end of the micromixer 200 at substantially the center of the width of the micromixer 200.

Because of the constraints on minimum and maximum channel widths, channel length is preferably varied to further adjust pressure drop. As shown in FIG. 9, this results in long, narrow channels towards the center of the mixer and shorter, wider channels at the outer limits.

Because the mechanical supports necessary for the bonding process to construct a micromixer as shown in FIG. 9 (e.g., the substantially rectangular wall structures) are simpler in shape and construction than the numerous pillars in previous embodiments, the production process can be simplified and the multiple laminae can be more easily aligned for bonding. This design can also improve the uniformity of load distribution throughout the micromixer, which can reduce buckling and deformation during bonding and operation of the micromixer.

Figure 10:
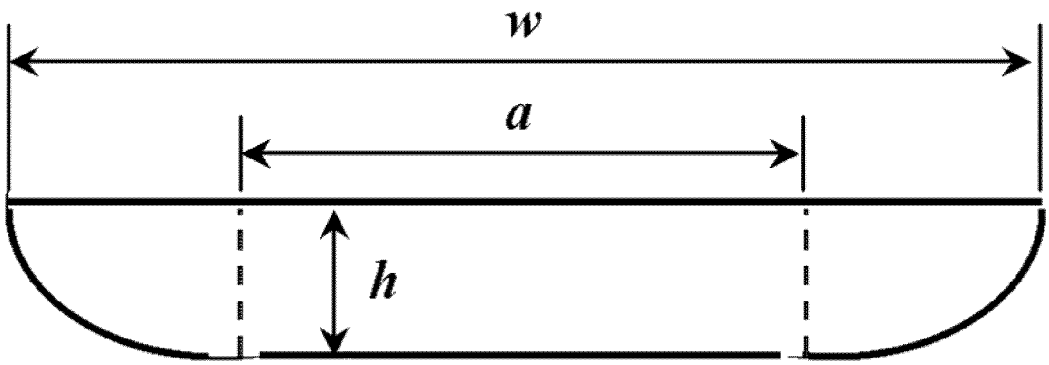
FIG. 10 illustrates dimensions used to determine hydraulic diameter for a rounded microchannel.

Generally, chemically etched microchannels are substantially rectangular, but not completely rectangular, and may have a cross-section as shown in FIG. 10. To include these geometric details, which have an impact on the fluid flow, into the CFD model would be prohibitively time consuming. Therefore, when modeling rectangular channels it is necessary to correct the model relative to a channel having a substantially round cross section using the generic parameter hydraulic diameter. For the purposes of this disclosure, the hydraulic diameter of a rounded (quarter-moon) channel was calculated using the following equation:

$$D_h = 2h\frac{\frac{a}{h}+\frac{\pi}{2}}{\frac{a}{h}+\frac{\pi}{2}+1} \tag{7}$$

where h is the height of the channel and a is the width of the rectangular region of the shape (FIG. 10).

Figure 11:
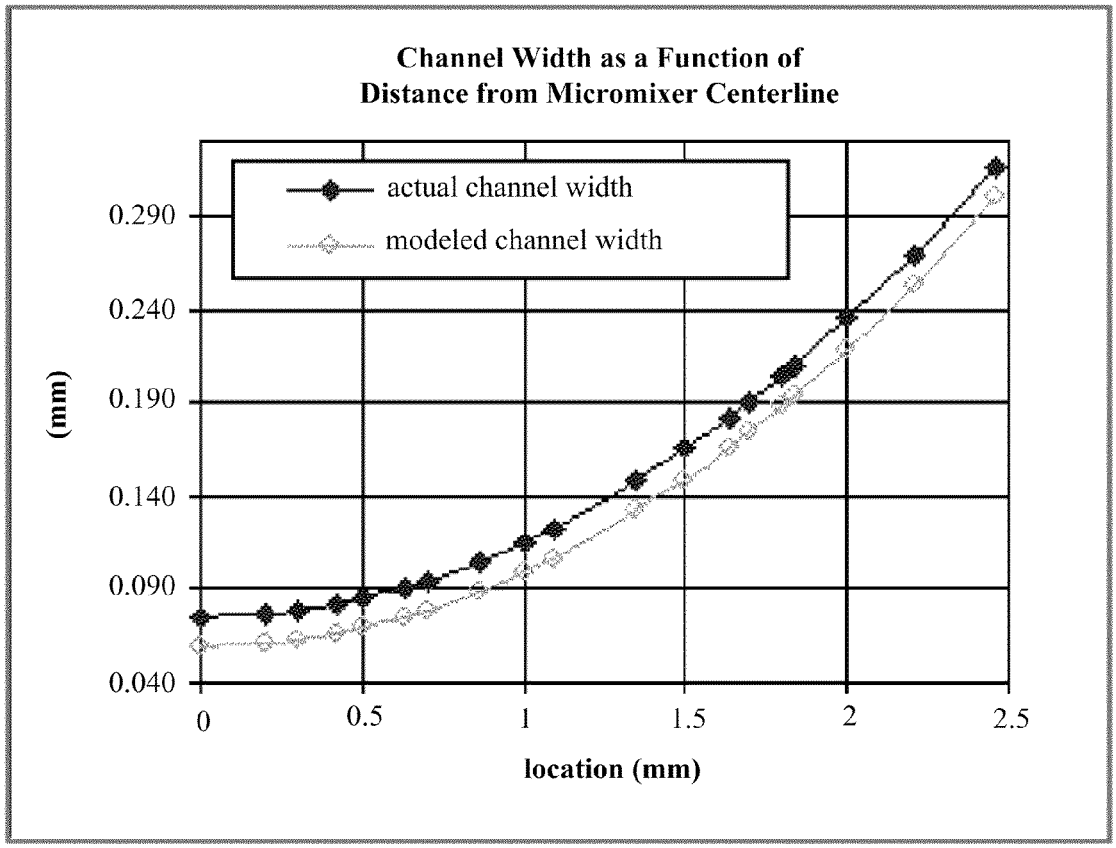
FIG. 11 illustrates a comparison of actual versus modeled channel width as a function of micromixer width, using a slope factor of c=0.04.

As shown in FIG. 11, a comparison of the hydraulic diameter for the half-moon with the rectangle reveals a significant difference in channel width. Therefore, when designing the micromixer using rectangular channels in CFD, the dimensions of the rectangular channels were adjusted to compensate for the hydraulic diameter of the half-moon shape of a chemically etched channel.

Figure 12:
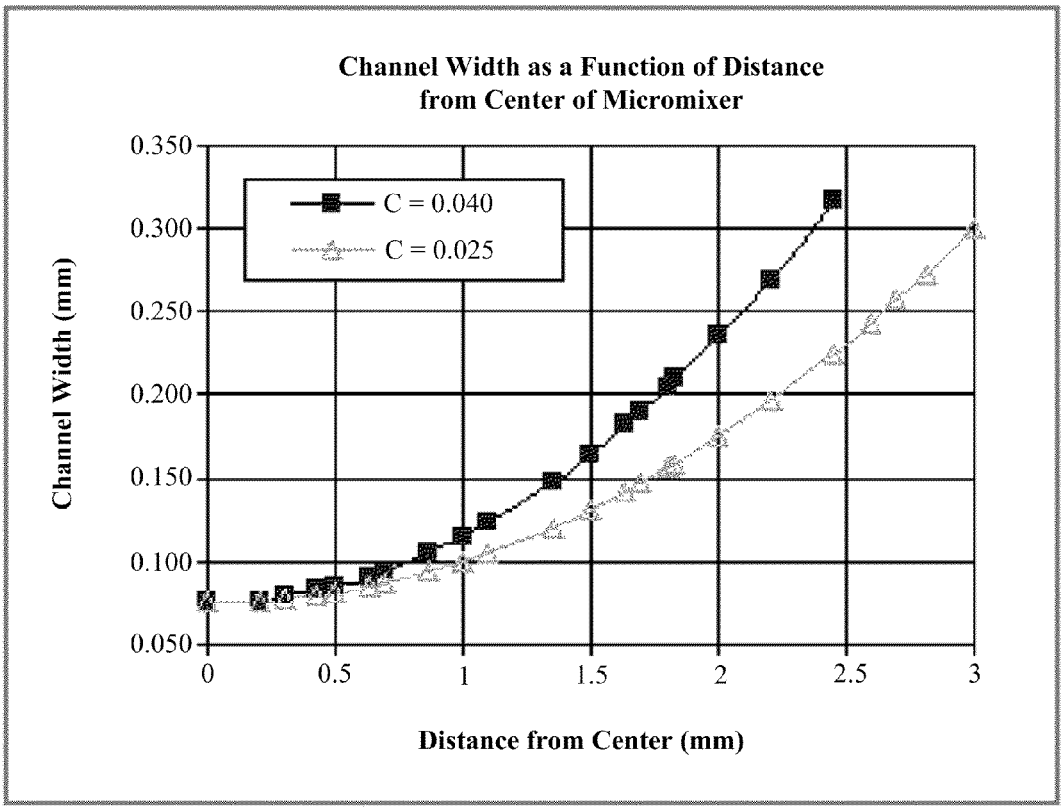
FIG. 12 illustrates channel width as a function of distance from the center of a micromixer.

Two values for the slope factor c were investigated for linear variation of channel length: 0.040 and 0.025. The slope factor c can vary based on the desired size and/or other desired parameters the micromixer. FIG. 12 reflects the differences between the channel widths as a result of the different slope factors. Three-dimensional CFD analyses were conducted using CFD-ACE+ for both configurations. Manifold channels were modeled as rectangular with hydraulic diameter equal to that of the required rounded channel.

Figure 13:
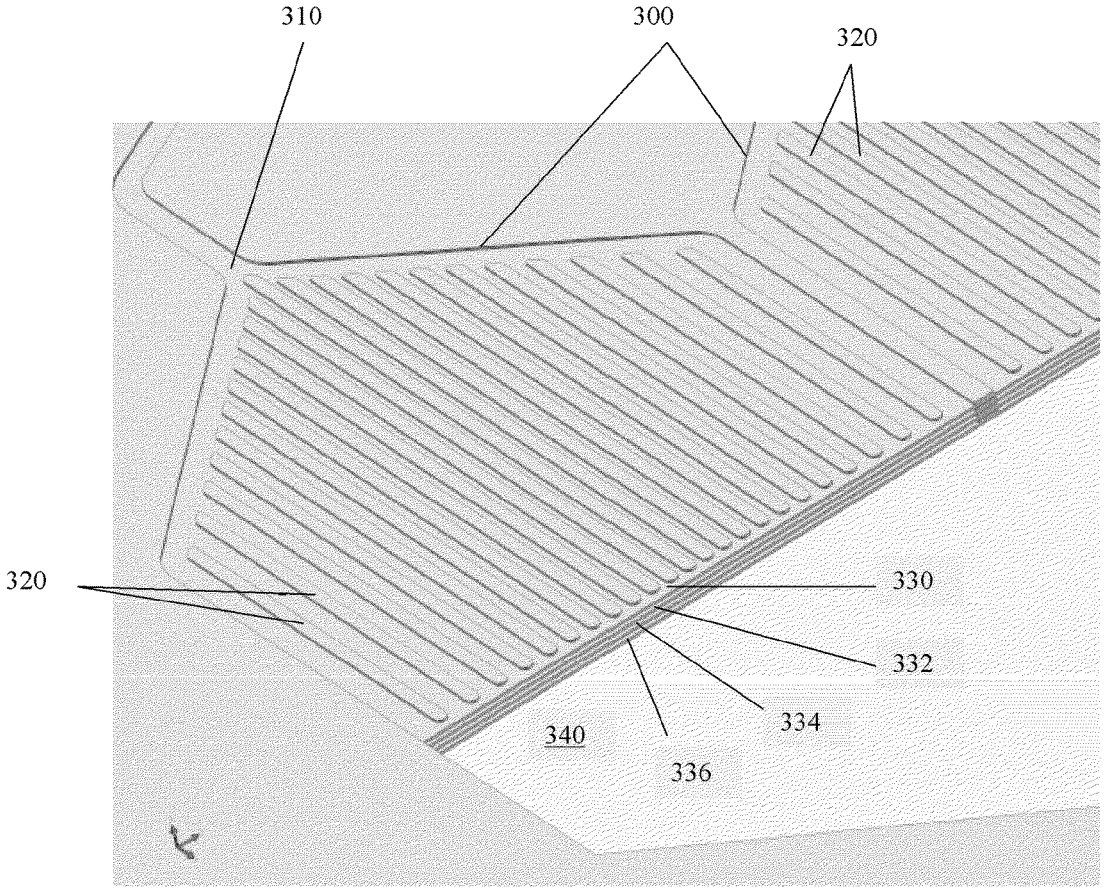
FIG. 13 illustrates a portion of a microchannel array comprising a plurality of laminae coupled together.
Figure 14:
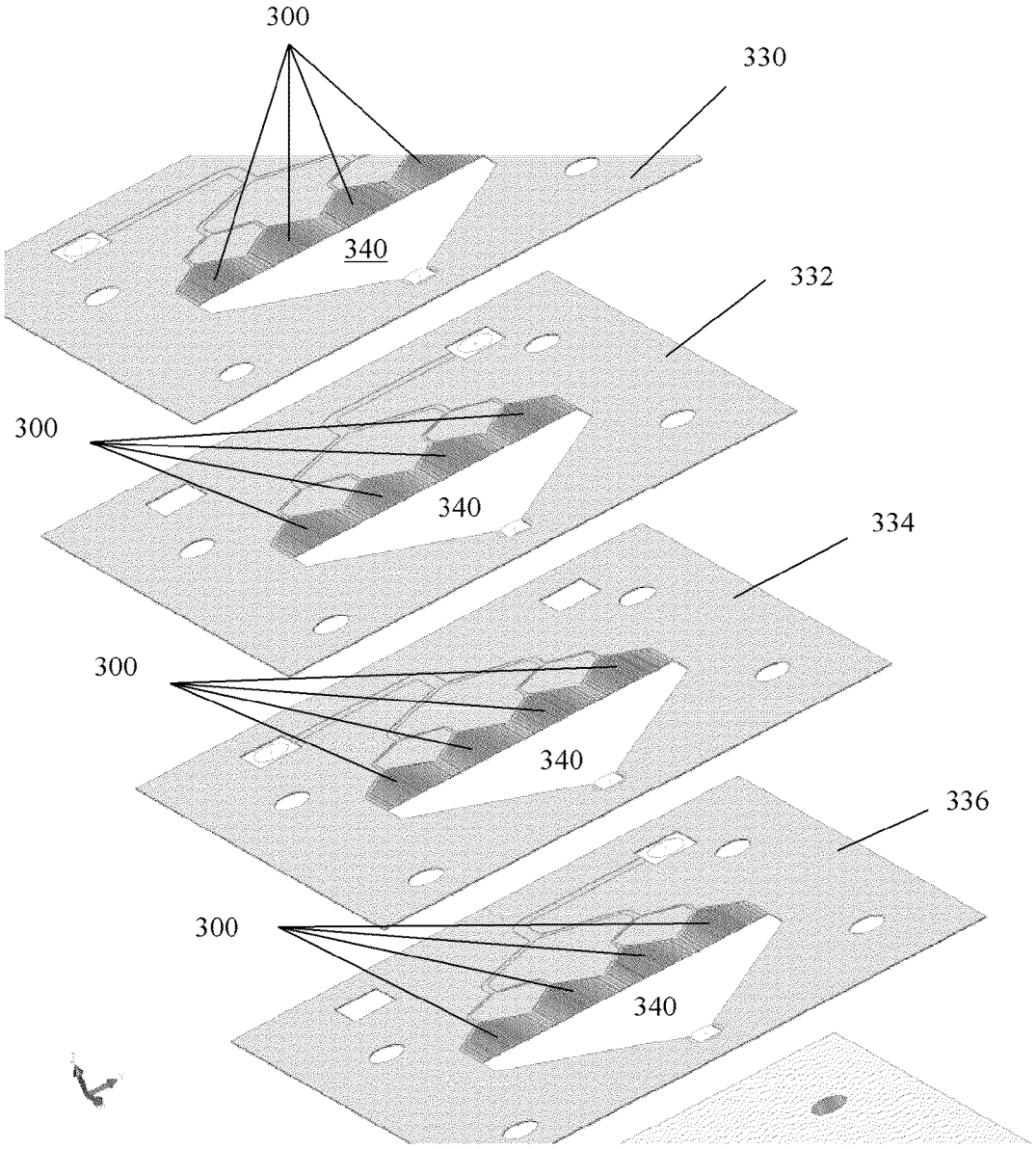
FIG. 14 illustrates an exploded view of the microchannel array shown in FIG. 13, shown with the laminae separated from one another in an exploded view.

FIGS. 13 and 14 illustrate a microchannel array with a plurality of micromixers 300 formed adjacent to one another on the same lamina and bonded to other lamina to provide a layered-up device. The microchannel array comprises a plurality of micromixers 300 with inlet regions 310 and formed of a plurality of channels 320 that vary parabolically in size (e.g., width of channel) in the manner described above with respect to FIG. 9. Referring to FIG. 13, a close up of the microchannel array illustrates several lamina 330, 332, 334, 336 bonded together to form a single unit. FIG. 14 illustrates an exploded view of the laminae 330, 332, 334, 336. As seen in FIG. 14, each of the lamina comprises a plurality of micromixers 300.

The outlet regions 340 of the micromixers 300 can comprise a mixing region for mixing different fluids. For example, a first fluid can be introduced into the microchannel array in alternating lamina (e.g., 330 and 334) and a second fluid can be introduced into the microchannel array in the remaining alternating lamina (e.g., 332 and 336). In this manner, two different fluids can exit the microchannel array and enter the mixing region for mixing. Of course, if desired each lamina could comprise a plurality of channels, with each lamina being configured to introduce more than one fluid into the mixing region.

Figure 15:
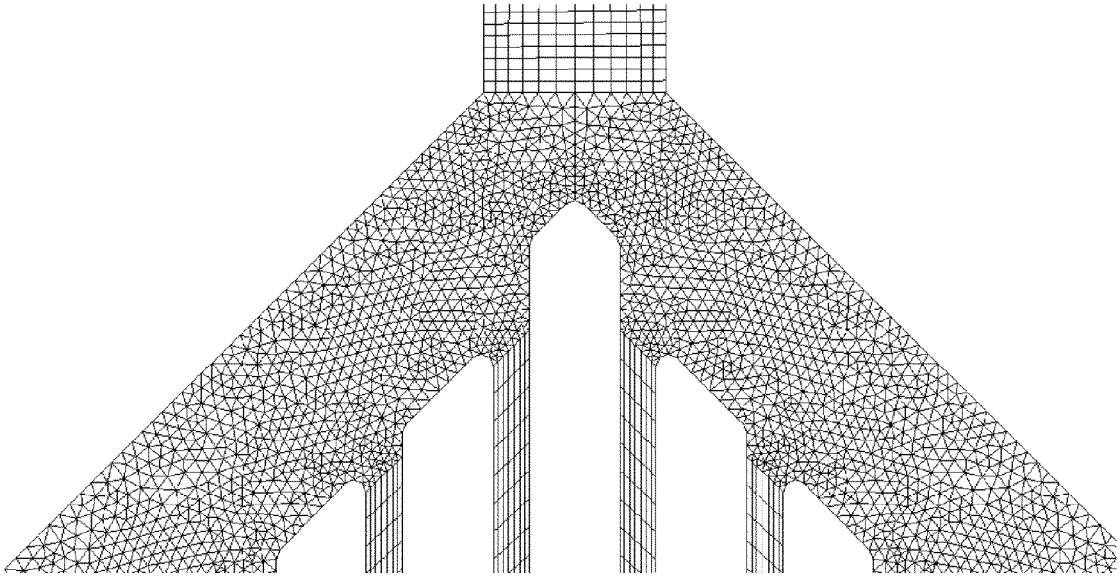
FIG. 15 illustrates a triangular mesh used in regions of complex geometry while a structured grid is applied in rectangular channels.

As shown in FIG. 15, a hybrid mesh can be configured to discretize the micromixer. The mesh can comprise a mix of triangles and rectangles linearly extruded to a thickness equal to the etch depth. Downstream, in the reservoir region, the grid can comprise triangles and rectangles extruded to a total thickness equal to that of the lamina. A structured grid can be used in rectangular sections of the geometry and triangles can be used in areas of complex geometry and to transition from fine to coarse regions of the grid.

Figure 16A:
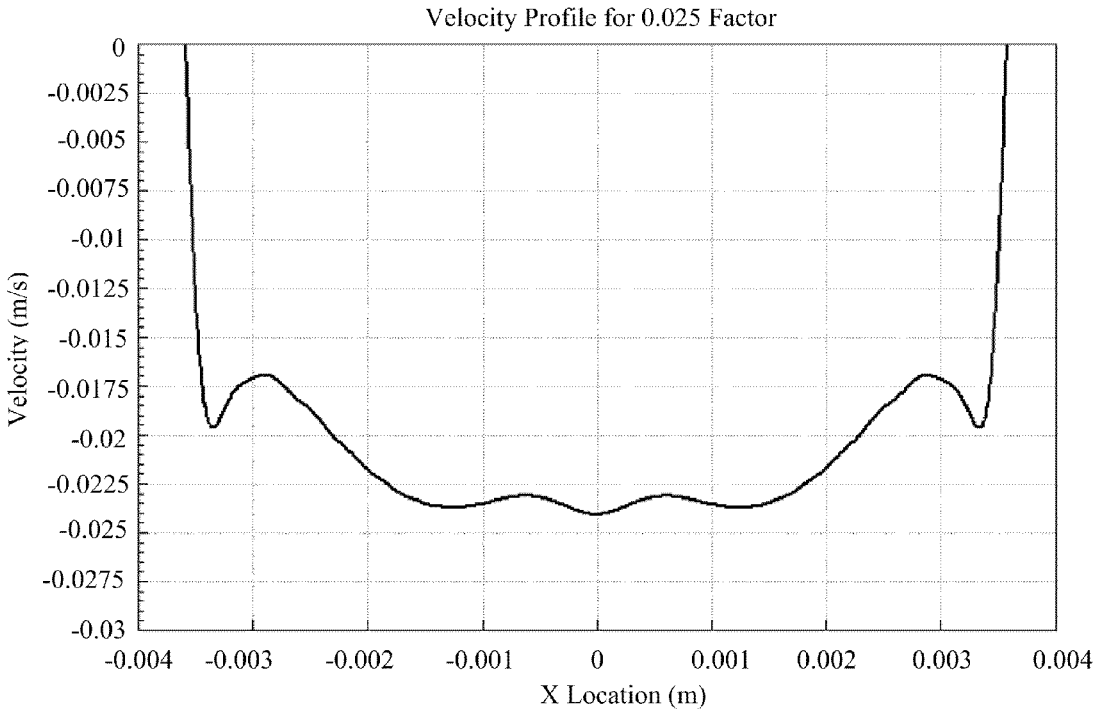
FIG. 16(*a*) illustrates a velocity profile for a micromixer having a slope factor of c=0.025.
Figure 16B:
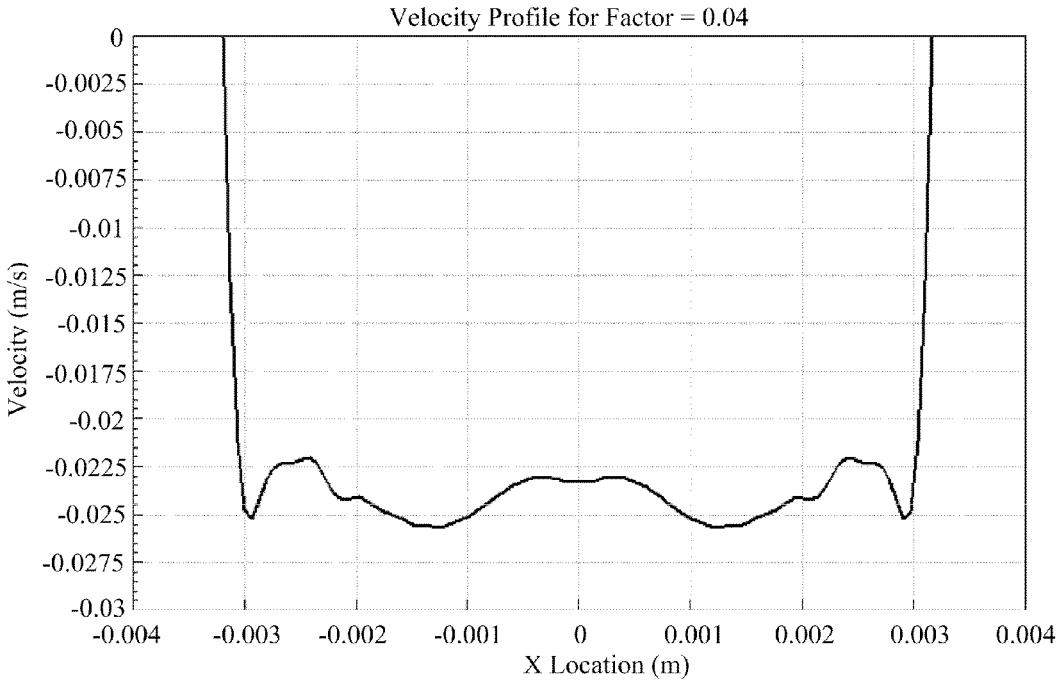

The velocity profile associated with a mixer geometry with a slope factor of 0.025 (c=0.025) is shown in FIG. 16(*a*). FIG. 16(*b*) shows a velocity profile associated with a mixer geometry with a slope factor of 0.040 (c=0.040). As shown in FIG. 16(*b*), the flow uniformity is improved for c=0.040 relative to c=0.025. In addition, the width of the outermost channels can be reduced to eliminate or reduce the velocity spikes in that region, further improving flow uniformity.

Accordingly, the micromixers described above are capable of producing a highly uniform velocity distribution. In addition, because of the relatively simple geometry, the manufacture and construction of such micromixers can be simplified. Also, to further optimize the geometry, only one parameter (i.e., the slope factor) need be considered. Moreover, if desired and/or useful, other design parameters can be used to further adjust and/or improve the functioning of the micromixer. For example, channel length can be used to help achieve a desired pressure drop.

Moreover, it should be understood that the embodiments described herein are exemplary and micromixers can be produced with channels of different shapes and manufacturing techniques (e.g., chemically etched, laser engraved, machined) without departing from the scope of the inventions disclosed herein.

Another concern in micromixer design for nanoparticle synthesis is clogging. High surface-area-to-volume ratios within microchannel mixers permit shorter diffusional distances allowing for rapid and precise mixing. Throughput can be directly scaled by "numbering-up" the number of channels in parallel. Acceleration of passive (diffusional) mixing in microchannel structures is generally governed by decreasingly smaller channels. Channels down to 25 micrometers in hydraulic diameter can be implemented; however, smaller channels can lead to problems with channel clogging for nanoparticle synthesis.

To reduce the effect of clogging, the following embodiments disclose larger microchannel structures (e.g., about 300 micrometer diameter) that achieve rapid, high-quality mixing using reversed oscillatory flow through microchannels with at least some portion that is not straight, such as a serpentine microchannel. For the purposes of this application, serpentine refers to a shape that repeatedly changes direction, either slowly (e.g., with rounded turns) or sharply (e.g., with turns of about 90 degrees). Larger microchannel dimensions can also make the device easier to fabricate and more difficult to clog. Reversed oscillatory flow through a serpentine channel results in much faster mixing over conventional flow patterns. Further, the design can be assembled and disassembled to make cleaning easier.

Figure 17:
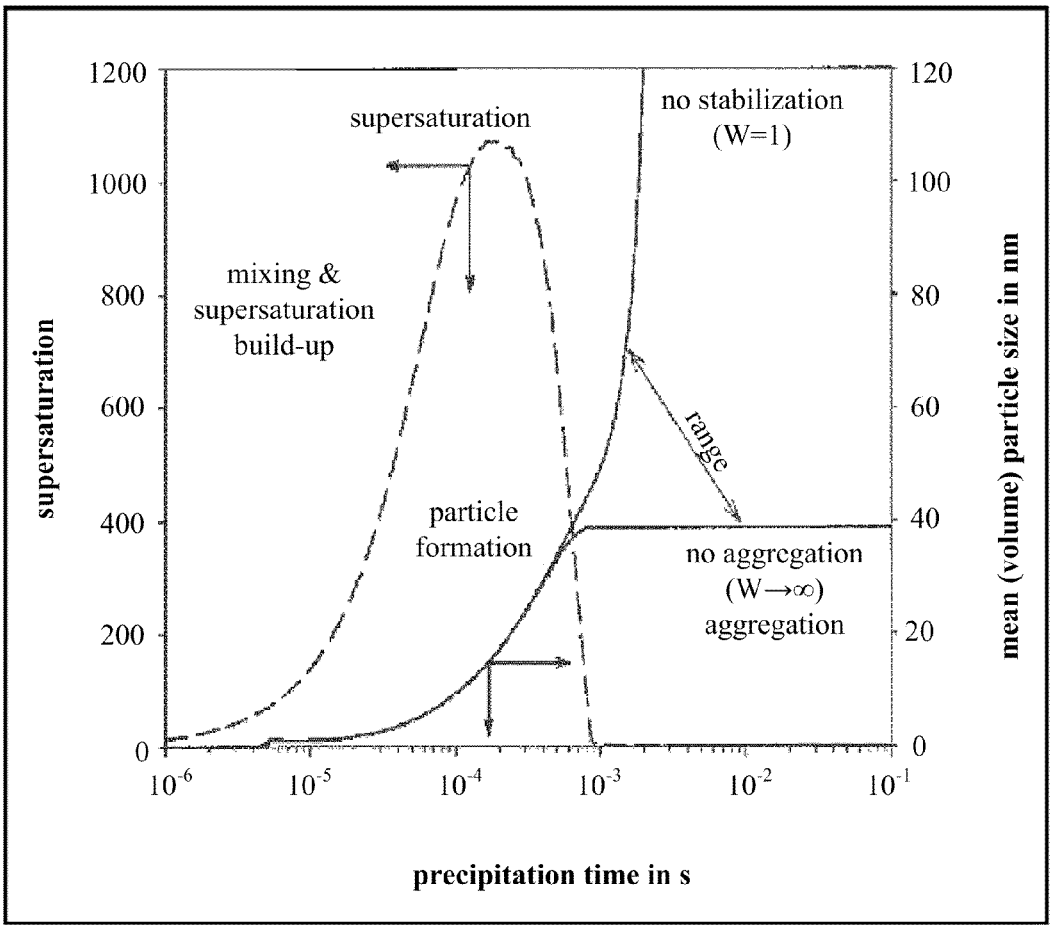
FIG. 17 illustrates an example of the time scales over which supersaturation, nucleation, and aggregation occur within typical precipitation chemistry reactions.

For the formation of nanoparticles by precipitation chemistry, high levels of supersaturation are desired. FIG. 17 shows an example of the time scales over which supersaturation, nucleation, and aggregation occur within typical precipitation chemistry reactions. The use of micromixers can greatly decrease mixing times by allowing for higher levels of supersaturation prior to nucleation. Higher levels of supersaturation can also lead to less variability in the onset of homogeneous nucleation and more uniform particle growth.

To improve mixing and shorten mixing times, the mixing systems disclosed herein do not necessarily rely solely on passive (diffusional) mixing mechanisms. Instead, the systems herein use reverse oscillatory flow in combination with nonlinear, serpentine microchannels to provide additional convective mechanisms for the rapid mixing of materials. Consequently, larger channels can be used while maintaining rapid mixing times. Also, if desired, the micromixers can be constructed of metal (instead of having brittle Si inserts which many conventional passive mixers use). The metal construction can simplify cleaning.

Passive mixing models have been developed, such as the passive T-mixing of colored water within a 275 μm channel as disclosed in Glasgow and Aubry 2003. (See Glasgow, I. and Aubry, N., (2003), "Enhancement of microfluidic mixing using time pulsing," *Lab on Chip*, Vol. 3, pp. 114-120.) Flow from both inlets is continuous and steady and does not result in complete mixing by the end of the channel. Moreover, while adding reverse oscillatory flow to or both inlets somewhat improved the results of the mixing, it did not result in flows that are fully mixed by the end of the channel.

Applicants have found that by replacing the T-mixer with a microchannel mixer having a serpentine channel results in significant, unexpected improvement in the standard deviation of the outlet concentration. In addition, if desired, the serpentine flow features can be machined, which can simplify production and reduce manufacturing costs.

Figure 18:
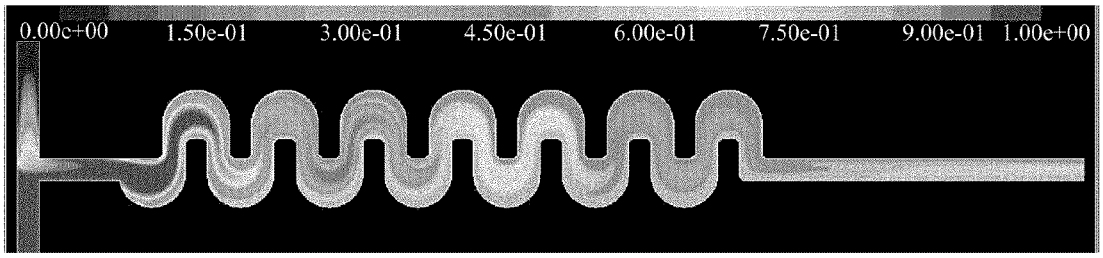
FIG. 18 shows computational fluid dynamic analysis of an axial cross-section of flow.
Figure 19:
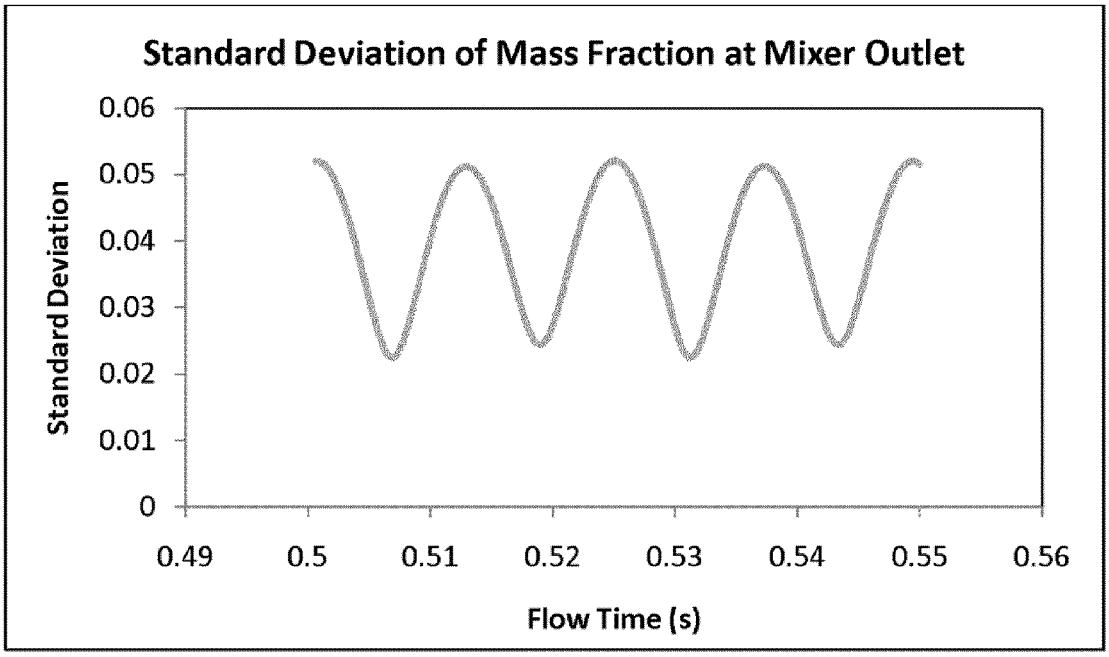
FIG. 19 shows resultant standard deviation of concentration at outlet as a function of time.

Referring to FIGS. 18 and 19, computational fluid dynamic results of reverse oscillatory flow 180 degrees out of phase in both inlets of a micromixer show significant improvement in mixing. FIG. 18 shows axial cross-section of flow and FIG. 19 shows resultant standard deviation of outlet concentration as a function of time. As shown in FIG. 19, mixing is improved to a standard deviation of concentration as low as about 0.02.

Figure 20:
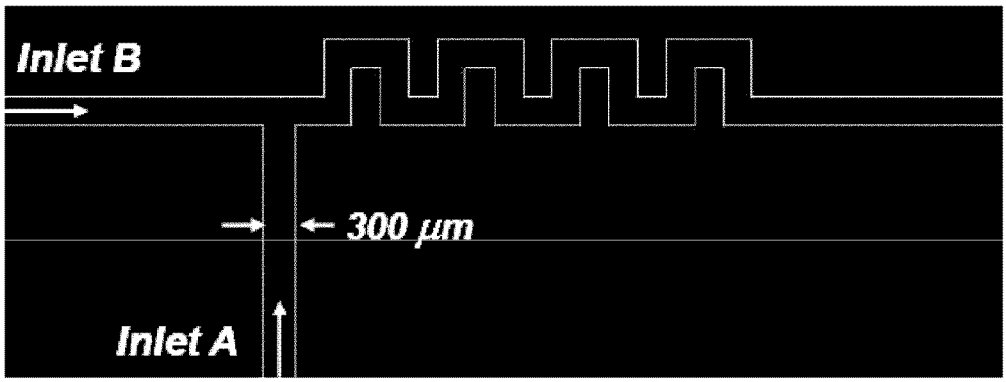
FIG. 20 illustrates an embodiment of a micromixer channel with a serpentine construction.
Figure 21:
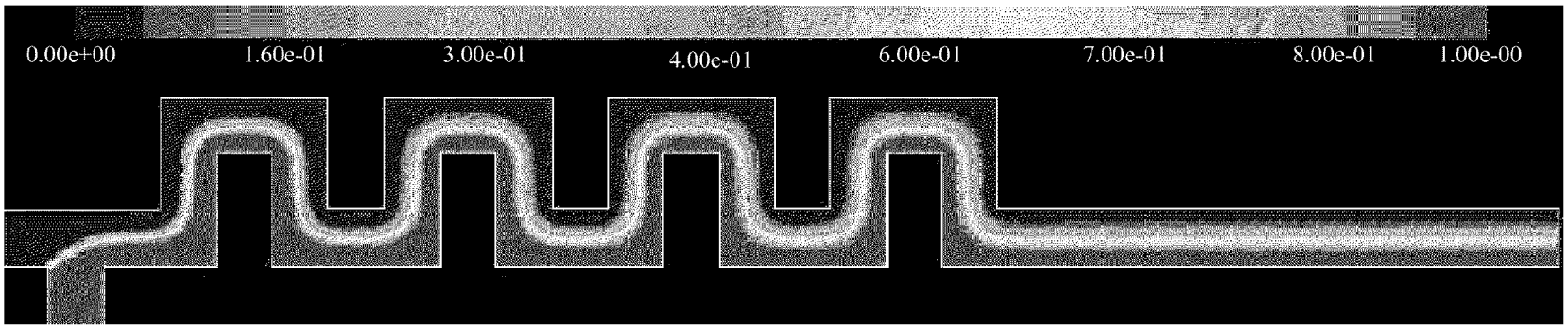
FIG. 21 illustrates a CFD analysis of the structure of FIG. 20 with an inlet velocity of 0.02 m/s (about 3.5 mL/min).
Figure 22:
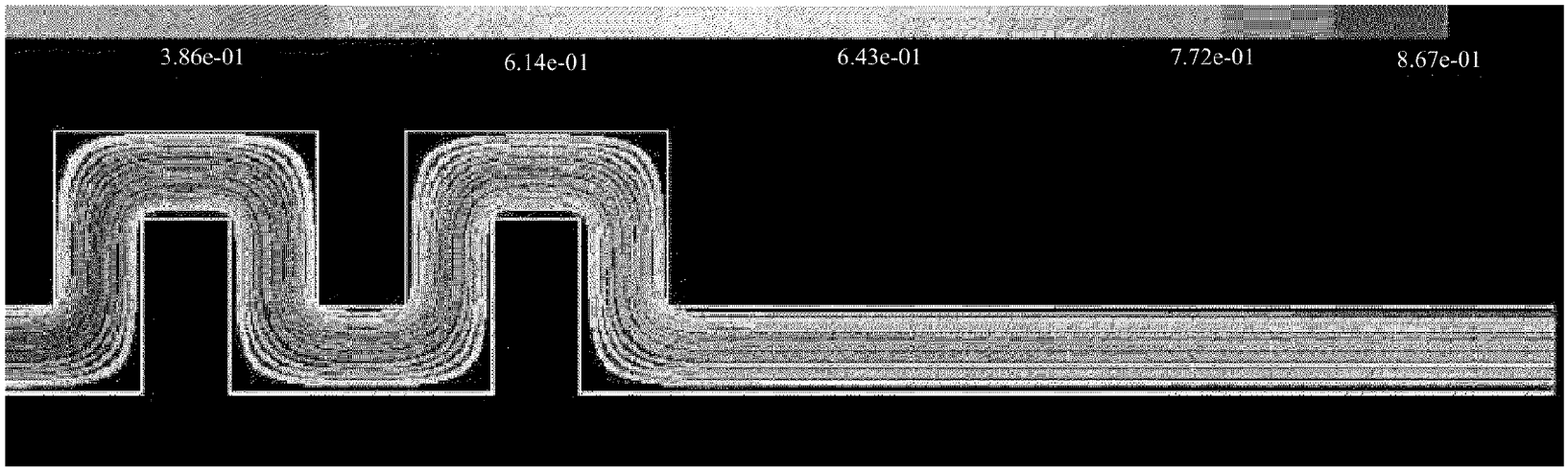
FIG. 22 illustrates an analysis of residence time distribution with the same micromixer channel.

FIGS. 20-22 illustrate an embodiment of a micromixer channel with a serpentine construction. FIG. 21 illustrates a CFD analysis of the structure of FIG. 20 with an inlet velocity of 0.02 m/s (about 3.5 mL/min). The standard deviation of species mass fraction at outlet was about 0.4024311. FIG. 22 illustrates an analysis of residence time distribution with the same micromixer channel.

Figure 23:
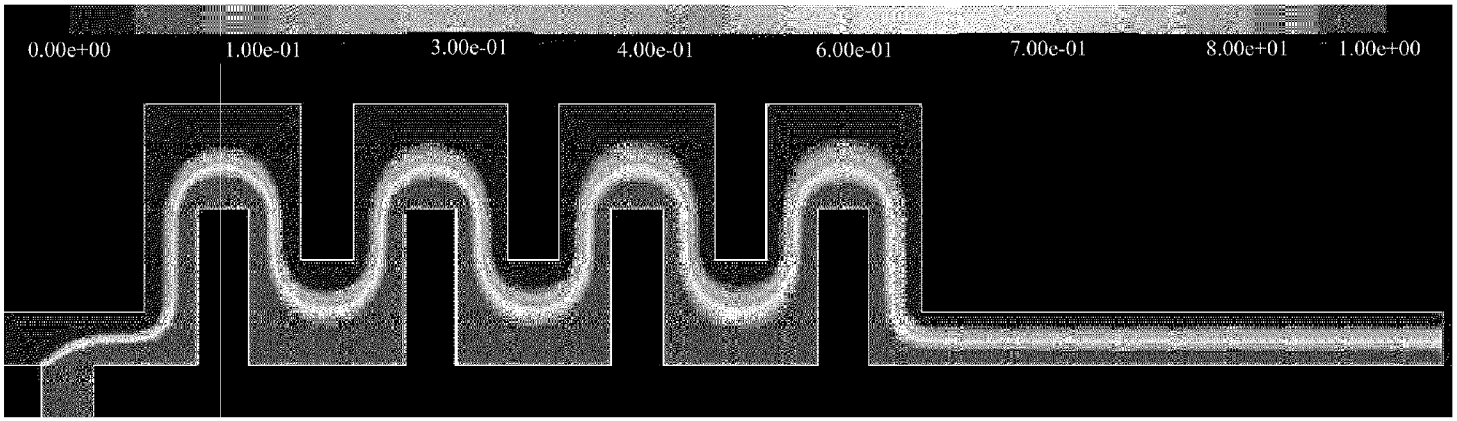
FIG. 23 illustrates an embodiment of a micromixer channel comprising a serpentine channel that expands at areas or regions where the flow changes direction (e.g., at turns in the microchannel) and contracts where the flow is in a region where the flow continues in one direction (e.g., where the flow does not change direction).
Figure 24:
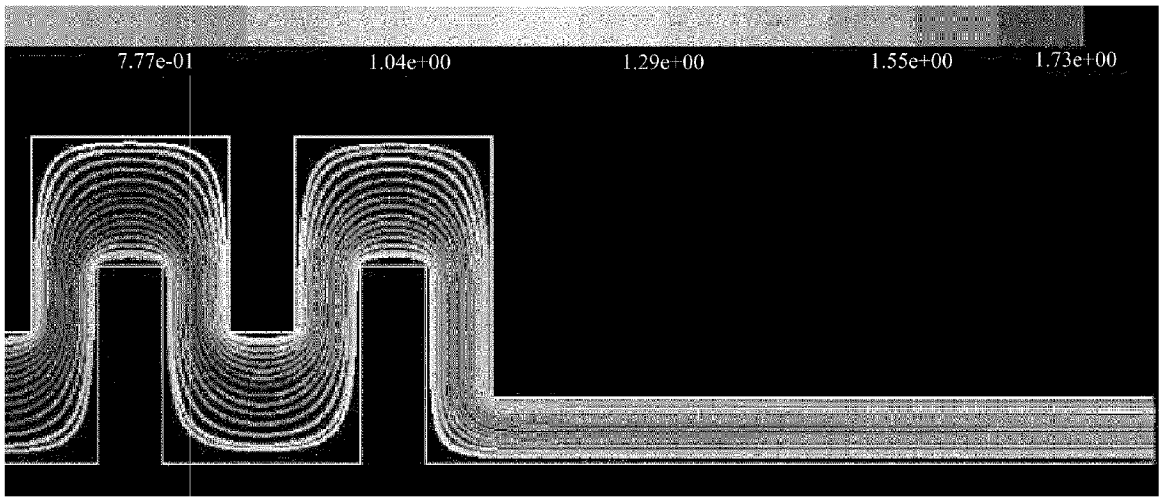
FIG. 24 illustrates an analysis of residence time distribution with the micromixer channel shown in FIG. 23.

FIGS. 23 and 24 illustrate an embodiment of a micromixer channel comprising a serpentine flowpath that expands in width at areas or regions where the flow changes direction (e.g., at turns in the microchannel) and contracts in width where the flow is in a region where the flow continues in one direction (e.g., where the flow does not change direction). The standard deviation of species mass fraction at outlet is about 0.41256413. FIG. 24 illustrates an analysis of residence time distribution with the micromixer channel shown in FIG. 23. Because of the increase in channel sizes (e.g., in the width of the channel at the regions where the flow changes direction), the residence time distribution of FIG. 24 is somewhat higher than that of FIG. 22.

Figure 25:
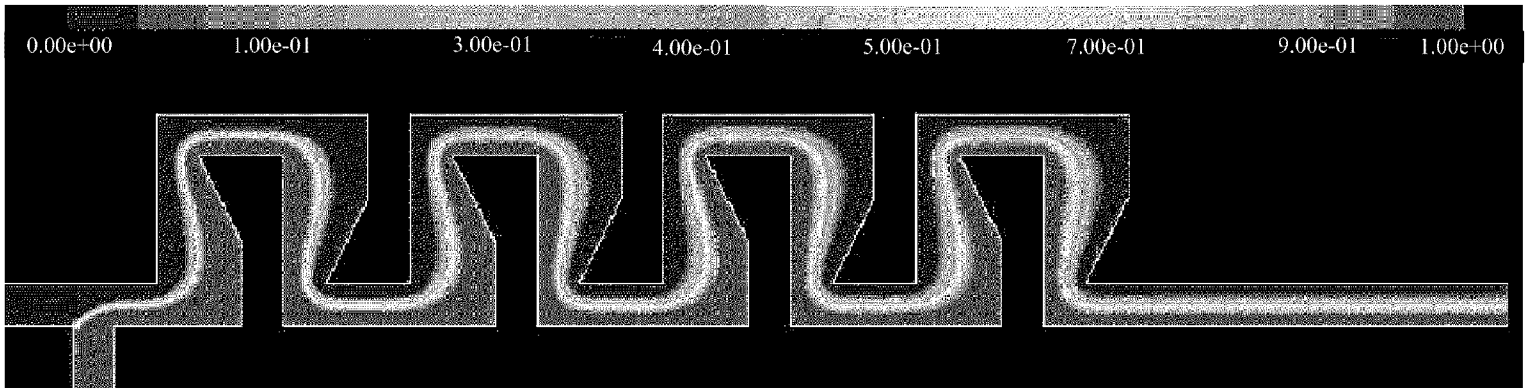
FIG. 25 illustrates an embodiment of a micromixer channel with alternating increasing width (expanded) regions and decreasing (constricted) width regions.
Figure 26:
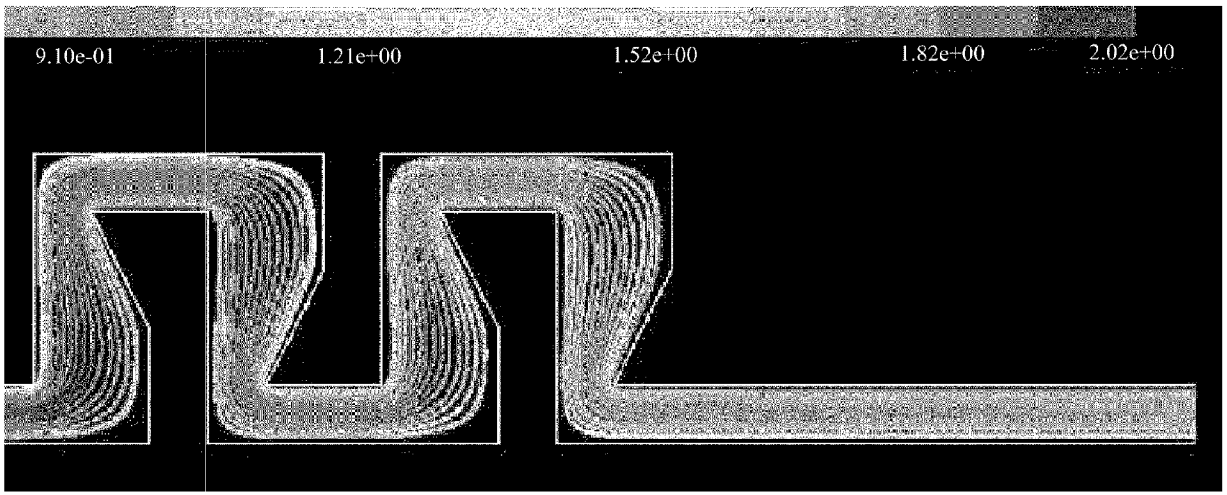
FIG. 26 illustrates a residence time distribution of the micromixer channel of FIG. 25.

FIGS. 25 and 26 illustrate an embodiment of a micromixer channel with alternating increasing width (expanded) regions and decreasing (constricted) width regions. That is, the micromixer channel comprises a serpentine channel in which the flow repeatedly changes directions. In a first region where the flow changes direction, the channel comprises an expanded region. In a second region, however, where the flow changes direction, the channel comprises a constricted region. If desired, the expanded and constricted regions can alternate throughout the micrmixer channel. FIG. 25 illustrates a CFD analysis of such a micromixer channel. The standard deviation of species mass fraction at outlet is about 0.40872991. FIG. 26 illustrates a residence time distribution of the same micromixer channel.

Figure 27:
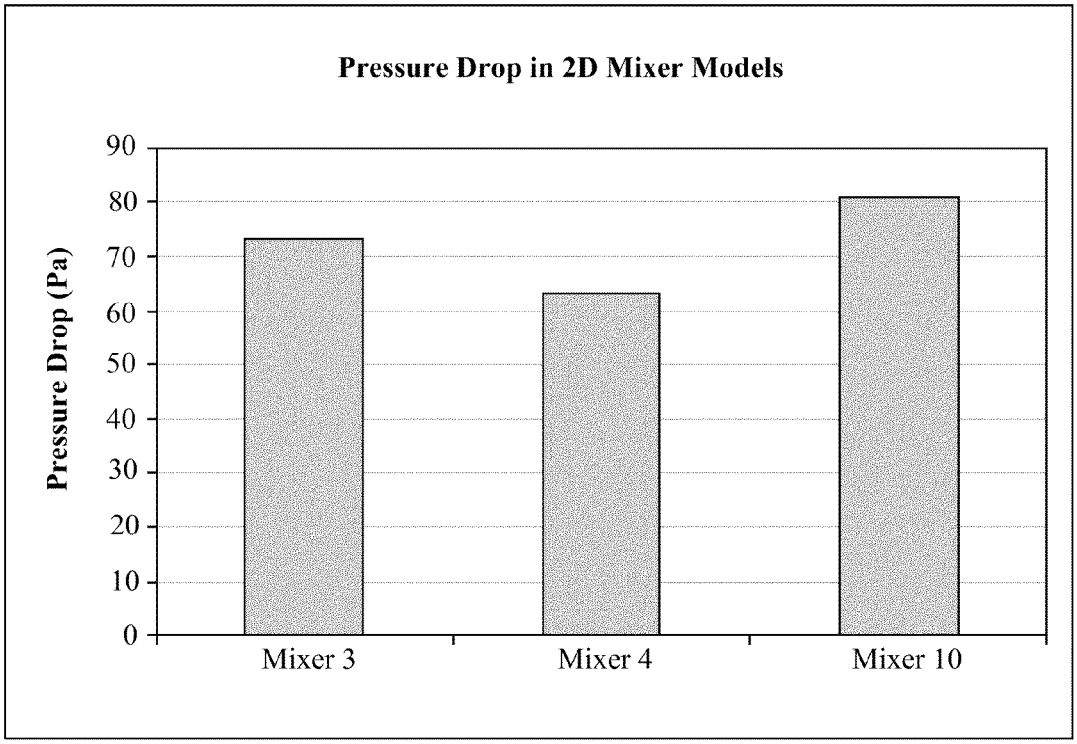
FIG. 27 illustrates pressure drops across the micromixer channels of FIG. 20 (i.e., Mixer 3), FIG. 23 (i.e., Mixer 4), and FIG. 25 (i.e., Mixer 10).
Figure 28:
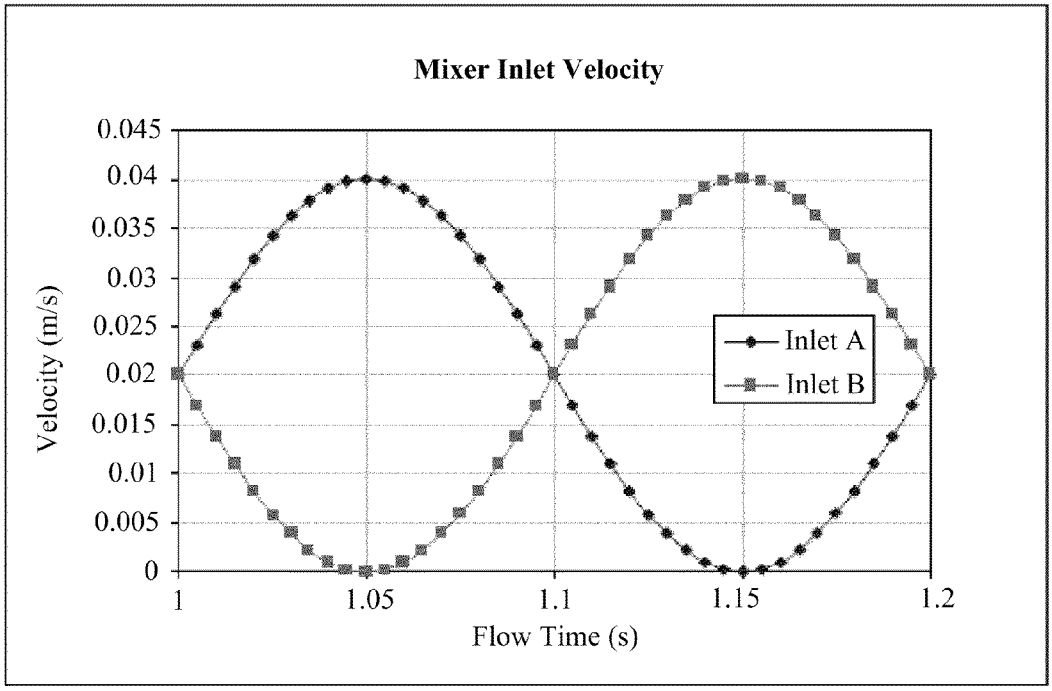
FIG. 28 illustrates a mixer inlet velocity that has a sinusoidal switched flow.

FIG. 27 illustrates pressure drops across the micromixer channels of FIG. 20 (i.e., Mixer 3), FIG. 23 (i.e., Mixer 4), and FIG. 25 (i.e., Mixer 10). FIG. 28 illustrates a mixer inlet velocity that has a flow that varies sinusoidally. As shown in FIG. 28, the flow of the two inlets (inlet A and B) are configured to be 180 degrees out of phase. The outlet velocity, however, remains substantially constant.

Figure 29:
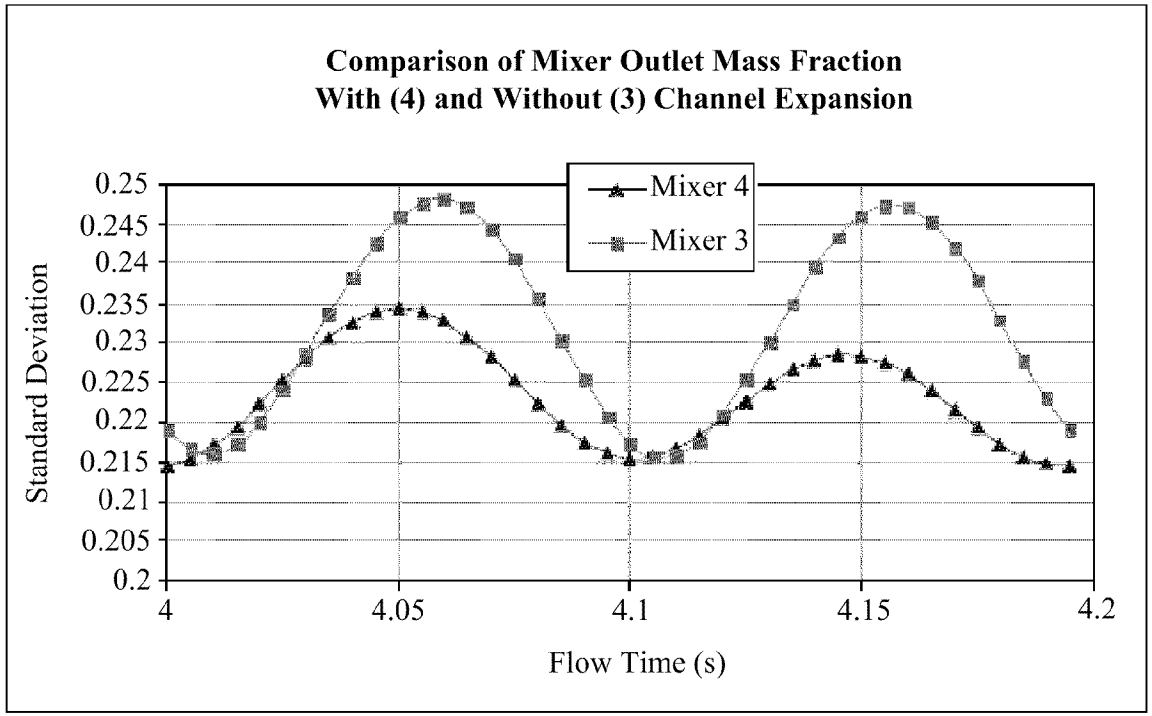
FIG. 29 illustrates a comparison of mixer outlet mass fraction between the micromixer channels of FIG. 20 (i.e., Mixer 3) and FIG. 23 (i.e., Mixer 4).
Figure 29:
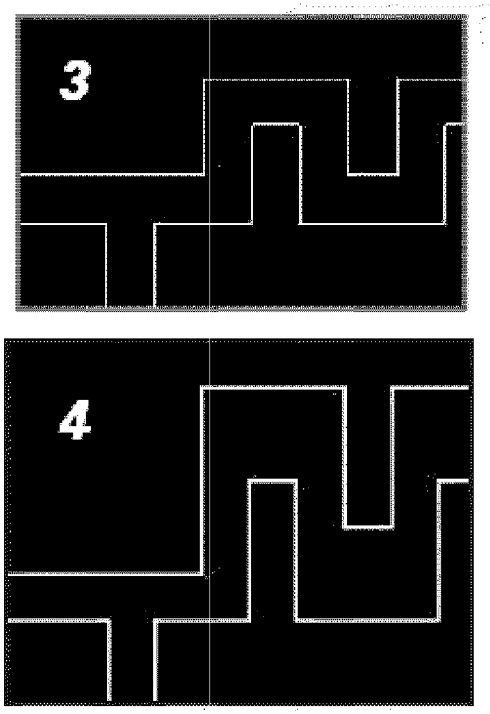
Figure 30:
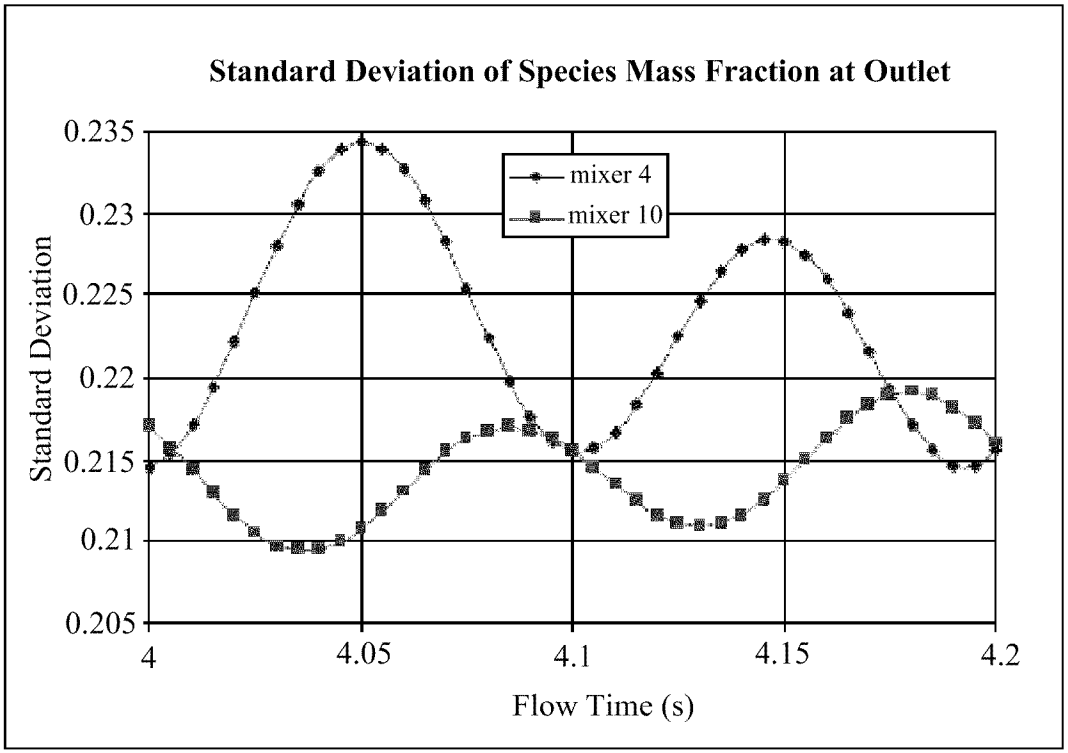
FIG. 30 illustrates a comparison of standard deviations of species mass fraction at outlet for the micromixers of FIG. 23 (i.e., Mixer 4) and FIG. 25 (i.e., Mixer 10).
Figure 30:
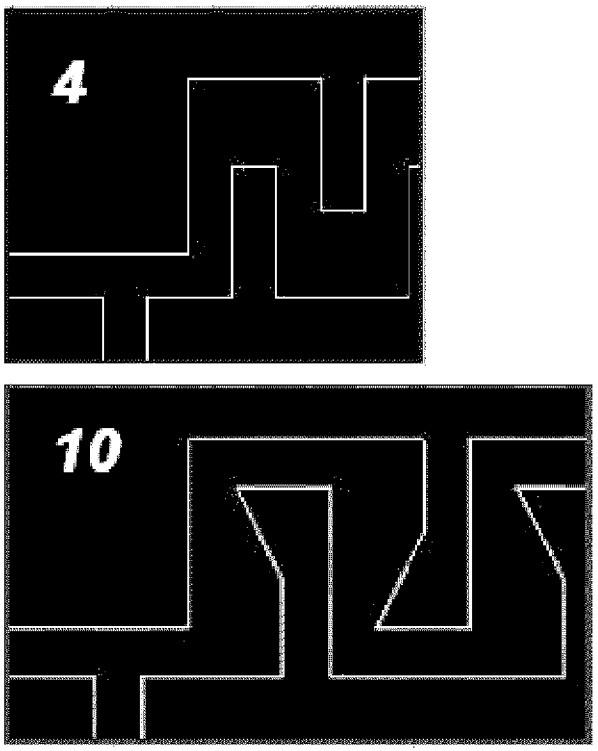
Figure 31:
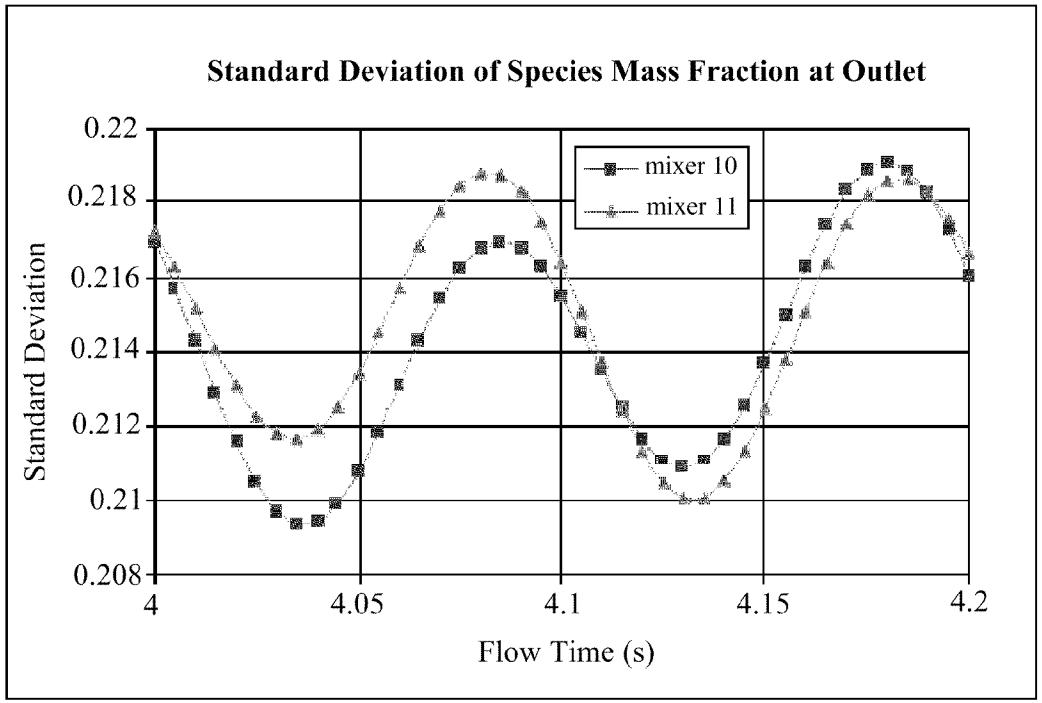
FIG. 31 illustrates a comparison of standard deviations of species mass fraction at outlet for the micromixers of FIG. 25 (i.e., Mixer 10) and Mixer 11 (similar to FIG. 25, but with the inlet relocated as shown in FIG. 31).
Figure 31:
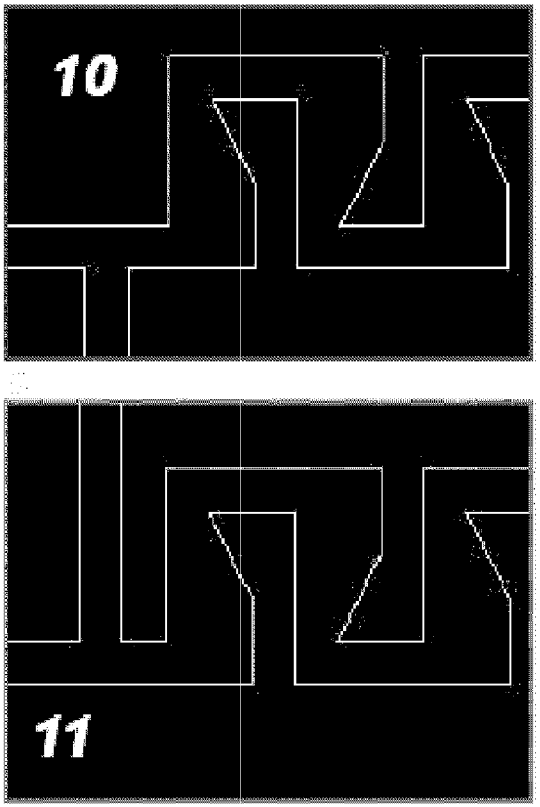
Figure 32:
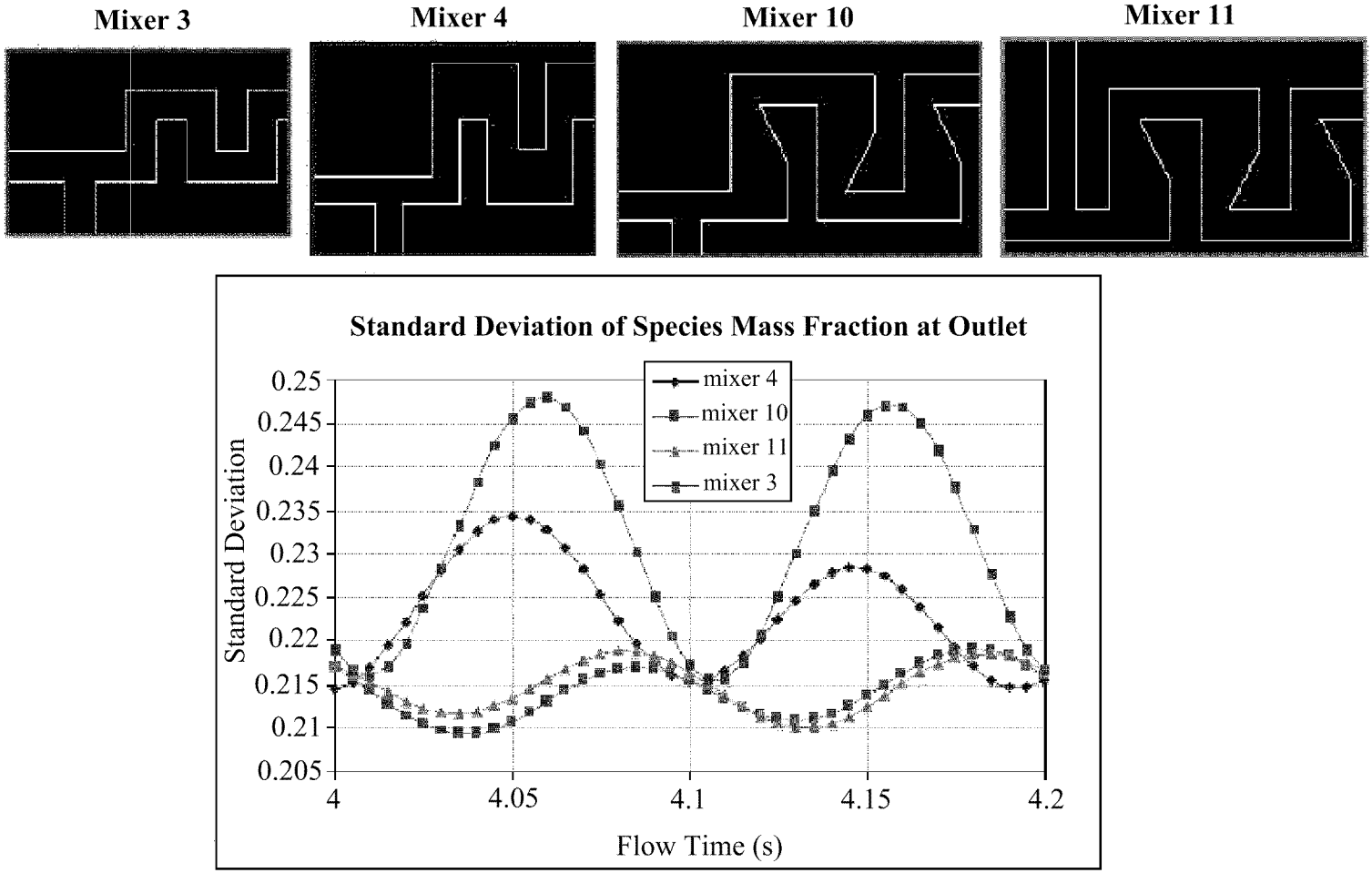
FIG. 32 illustrates a comparison of standard deviations for the micromixers of FIG. 20 (i.e., Mixer 3), FIG. 23 (i.e., Mixer 4), FIG. 25 (i.e., Mixer 10), and Mixer 11 (shown in FIGS. 31 and 32).

FIG. 29 illustrates a comparison of mixer outlet mass fraction between the micromixer channels of FIG. 20 (i.e., Mixer 3) and FIG. 23 (i.e., Mixer 4). FIG. 30 illustrates a comparison of standard deviations of outlet species mass fraction for the micromixers of FIG. 23 (i.e., Mixer 4) and FIG. 25 (i.e., Mixer 10). FIG. 31 illustrates a comparison of standard deviations of species mass fraction at outlet for the micromixers of FIG. 25 (i.e., Mixer 10) and Mixer 11 (similar to FIG. 25, but with the inlet relocated as shown in FIG. 31). FIG. 32 illustrates a comparison of standard deviations for the micromixers of FIG. 20 (i.e., Mixer 3), FIG. 23 (i.e., Mixer 4), FIG. 25 (i.e., Mixer 10), and Mixer 11 (shown in FIGS. 31 and 32).

Figure 33:
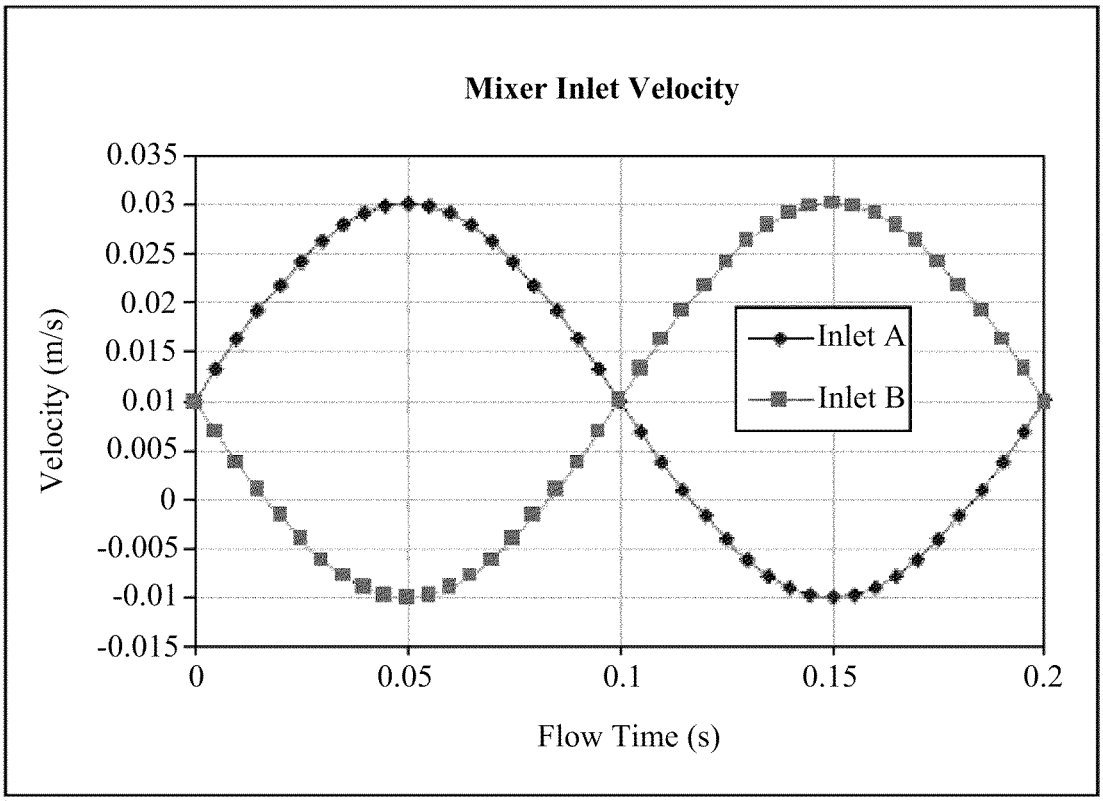
FIG. 33 illustrates an embodiment of inlet velocity for a micromixer.
Figure 34:
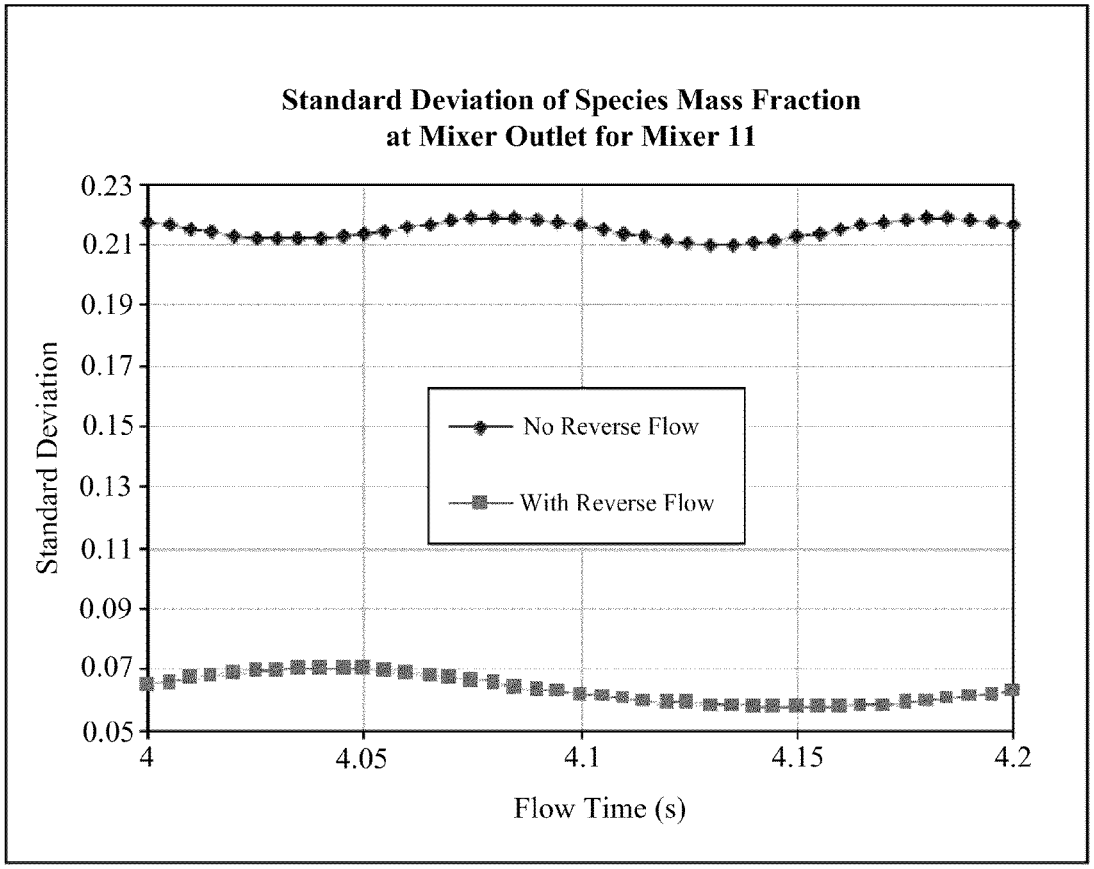
FIG. 34 illustrates a standard deviation of species mass fraction at mixer outlet for Mixer 11 (shown in FIGS. 31 and 32).

FIG. 33 illustrates an embodiment where inlet velocity is varied for a micromixer having two inlets A and B. The flow of the two inlets is 180 degrees out of phase with flow velocity varying between −0.01 m/s and +0.03 m/s. FIG. 34 illustrates a standard deviation of species mass fraction at mixer outlet for Mixer 11 (shown in FIGS. 31 and 32). As shown in FIG. 34 reversed switched flow significantly improves mixing. In addition, the segments of liquid A and B are better formed.

Figure 35:
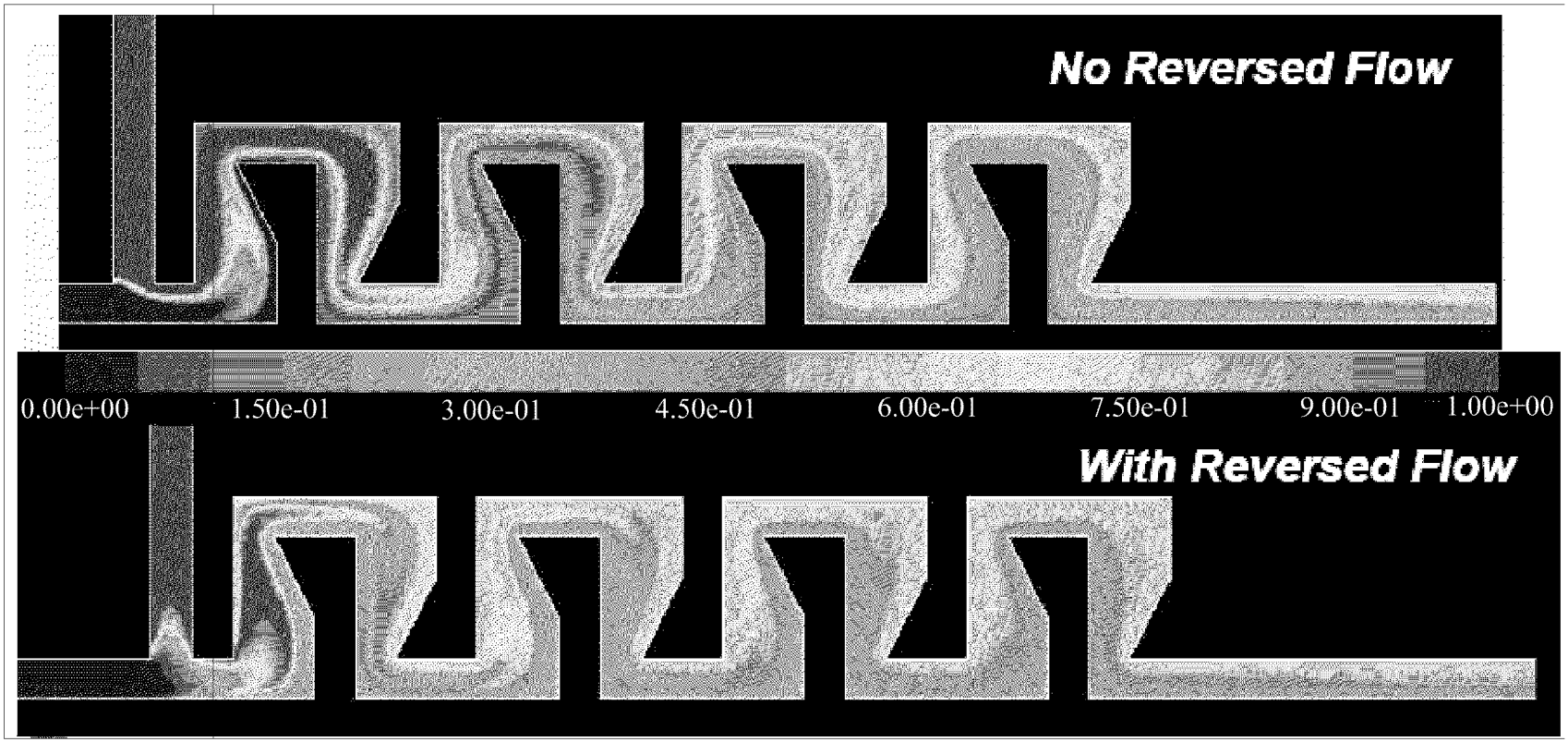
FIG. 35 illustrates CFD analysis of the contours of species mass fraction at beginning of the cycle without and with reversed flow.
Figure 36:
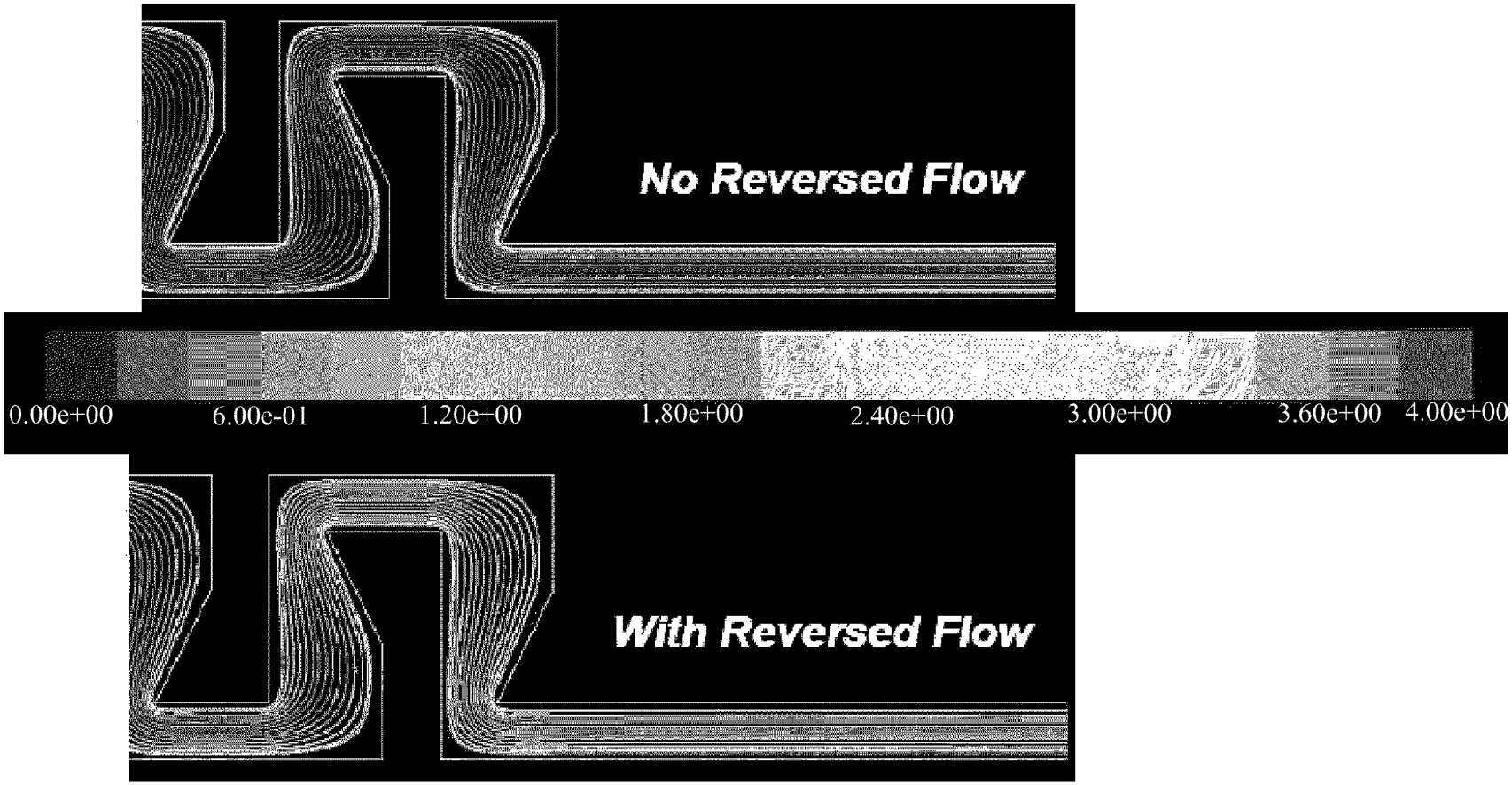
FIG. 36 illustrates residence time distributions without and with reversed flow.

FIG. 35 illustrates CFD analysis of the contours of species mass fraction at the beginning of the cycle without and with reversed flow. FIG. 35 clearly shows the improvement in mixing that is obtained with reversed flow. FIG. 36 illustrates residence time distributions without and with reversed flow. The residence time distributions were broadened by reversed flow.

If desired, pulse volume can be adjusted to improve mixing and residence time distributions. Pulse volume determines the volume of fluid flowing into the microchannel per cycle. Pulse volume can be adjusted by altering the flow velocity magnitude and/or the pulse duration/frequency.

Figure 37:
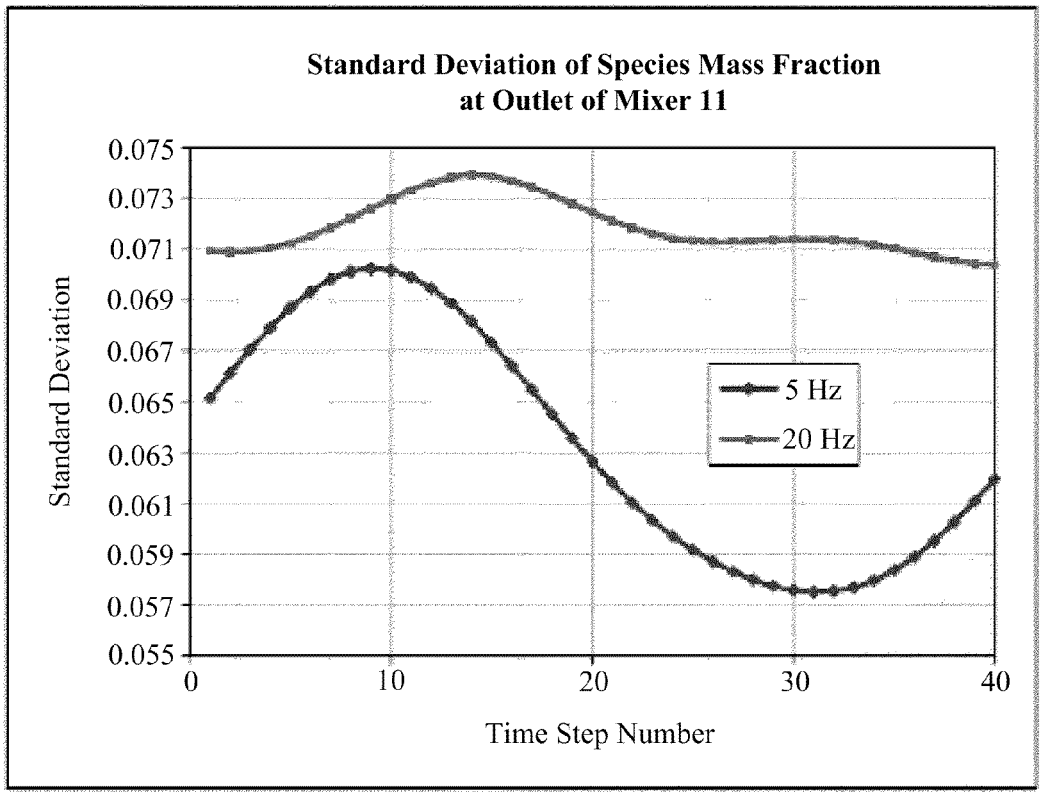
FIG. 37 illustrates a comparison of standard deviations of species mass fraction at outlet for Mixer 11 with a pulse frequency of 5 Hz and 20 Hz.
Figure 38:
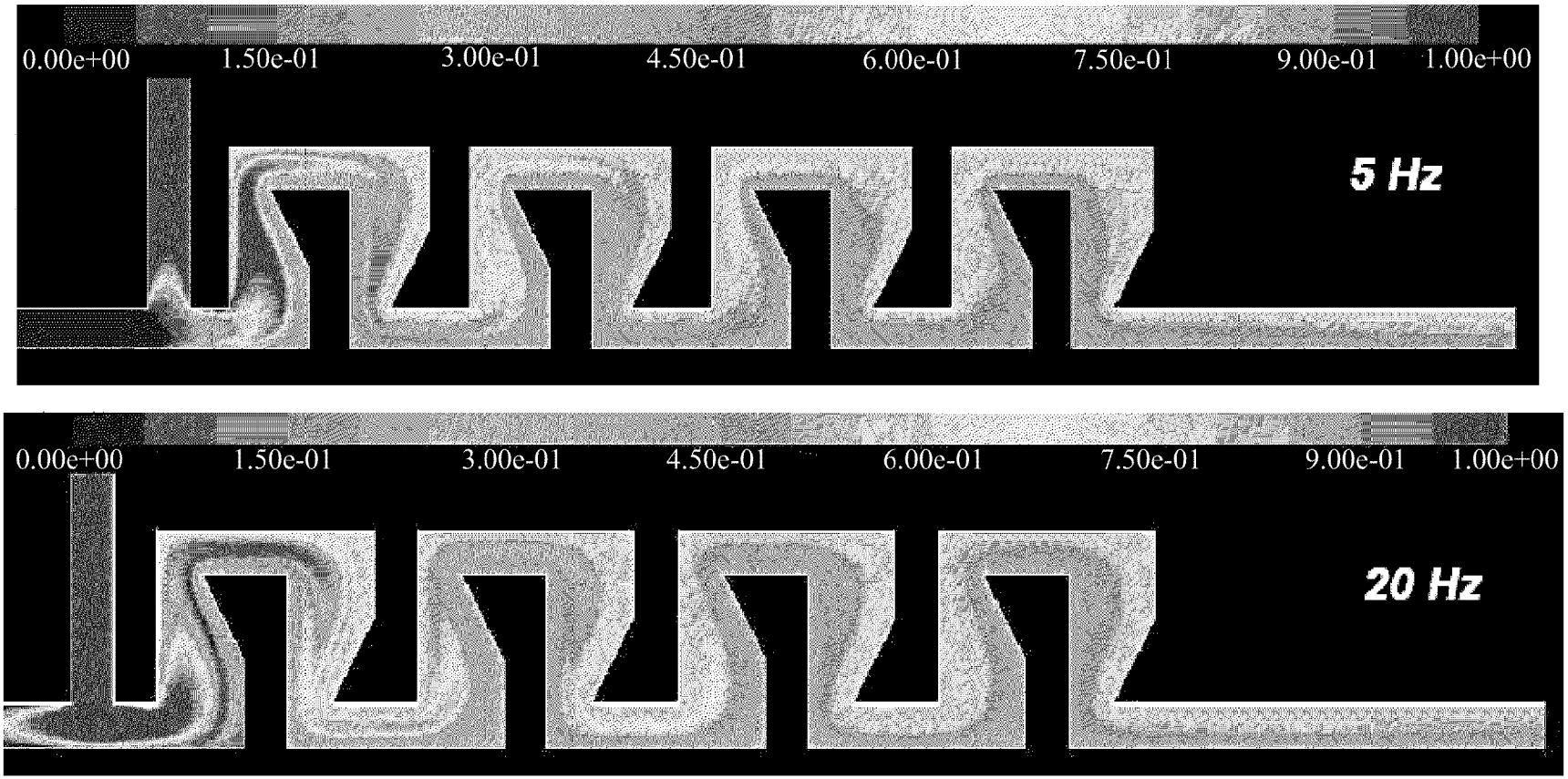
FIG. 38 illustrates a CFD analysis of the contours of species mass fraction for 5 Hz and 30 Hz systems.
Figure 39:
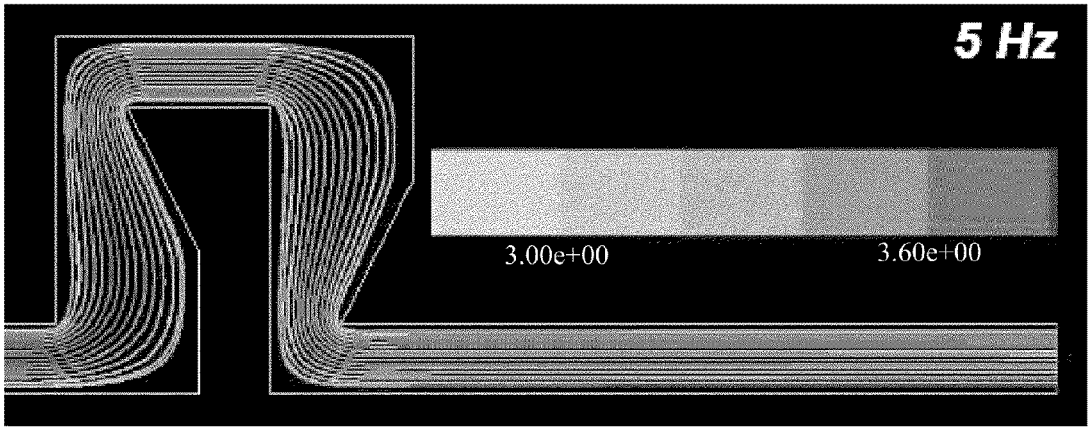
FIG. 39 illustrates a residence time distributions for a pulsed flow frequency of 5 Hz.
Figure 40:
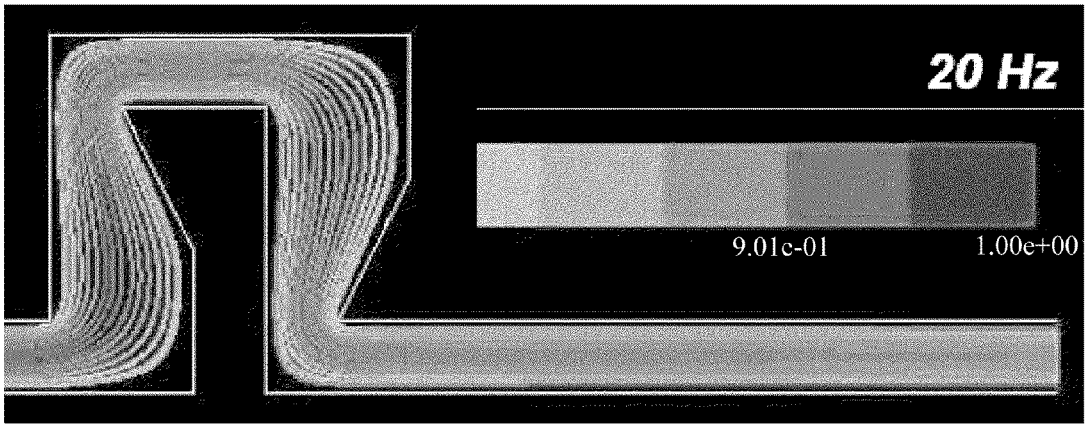
FIG. 40 illustrates a residence time distributions for a pulsed flow frequency of 20 Hz.
Figure 41:
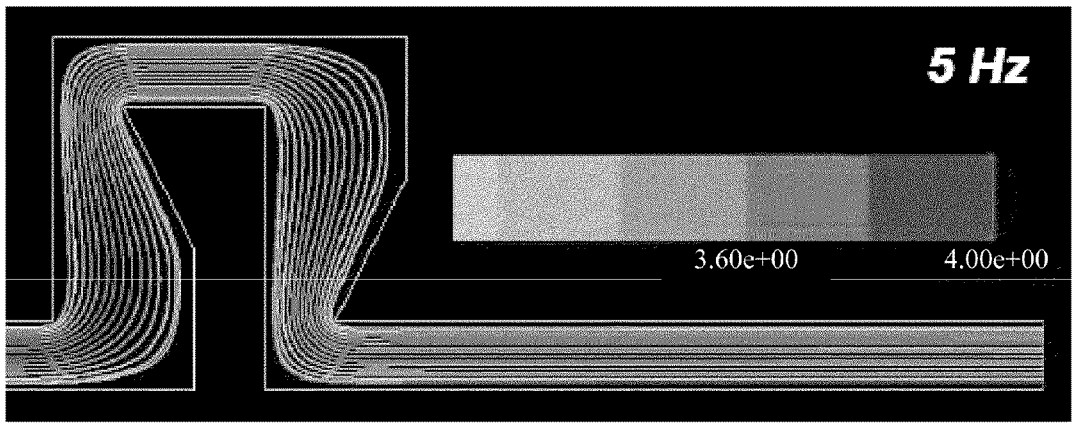
FIG. 41 illustrates a residence time distributions for a pulsed flow frequency of 5 Hz.
Figure 42:
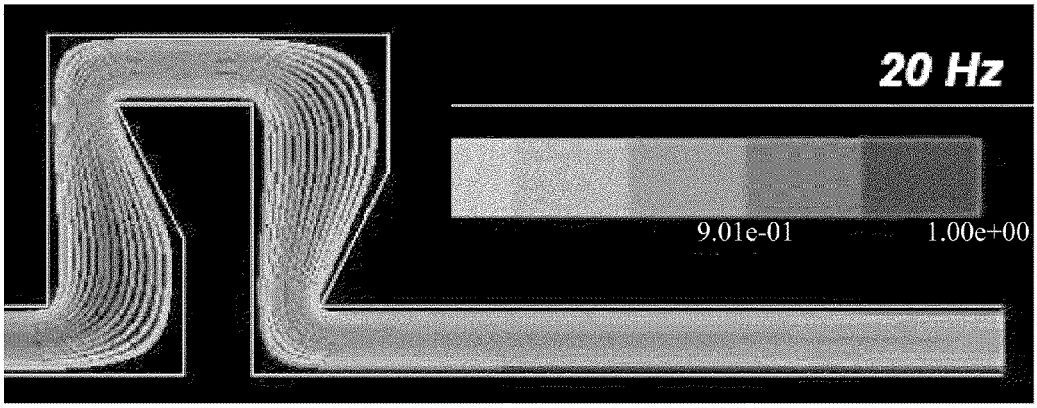
FIG. 42 illustrates a residence time distributions for a pulsed flow frequency of 20 Hz.

The higher the pulse frequency, the better the mixing that is achieved. FIG. 37 illustrates a comparison of standard deviations of species mass fraction at outlet for Mixer 11 with a pulse frequency of 5 Hz and 20 Hz. FIG. 38 illustrates a CFD analysis of the contours of species mass fraction for 5 Hz and 30 Hz systems.

FIGS. 39-42 illustrate the influence of frequency on residence time distributions, which appears to be substantially linear. For example, the residence time distribution decreased about 4 times with a 4 times increase in frequency and velocity magnitude.

Figure 43:
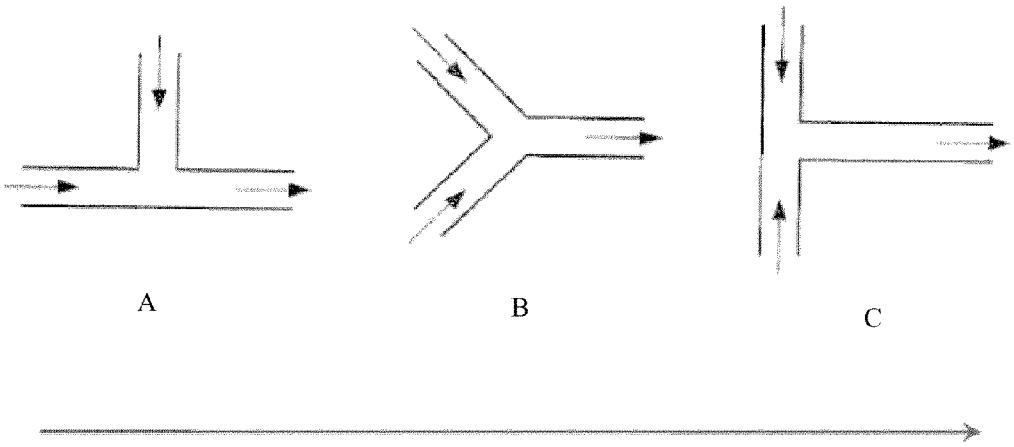
FIG. 43 illustrates several inlet configurations for a micromixer.

FIG. 43 illustrates improvements in mixing based on the inlet orientations. As shown in FIG. 43, with a reverse flow that is 180 degrees out of phase, it is preferable that the inlet orientation be such that the two inlets are oriented in opposing flow directions.

Figure 44:
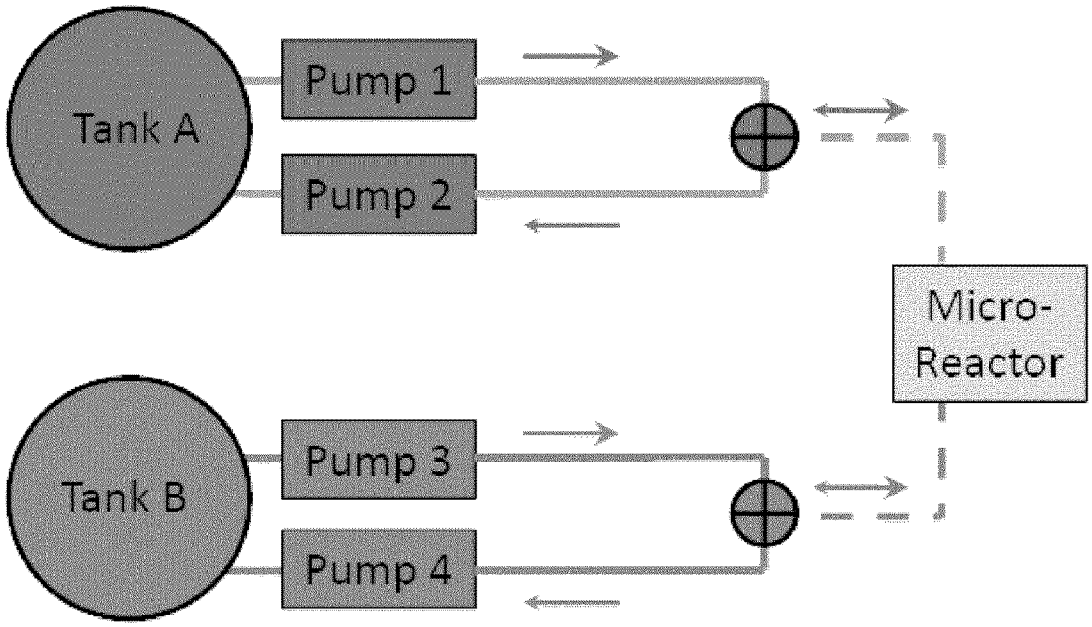
FIG. 44 illustrates a pump system for sinusoidal flow.
Figure 45:
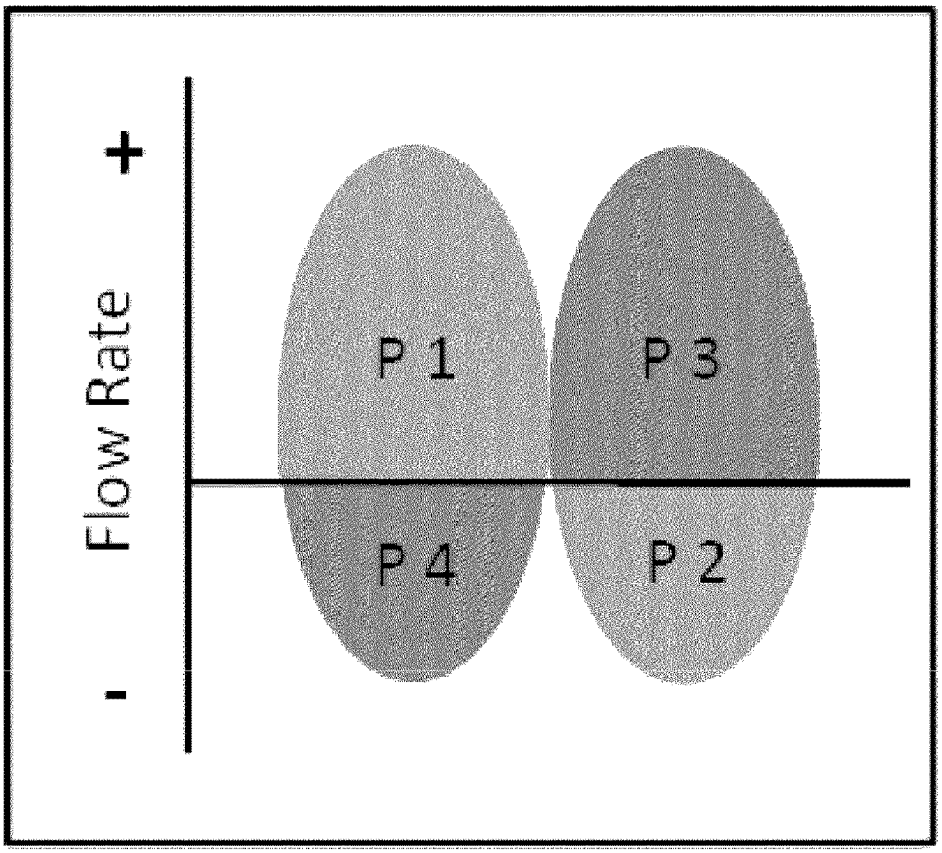
FIG. 45 illustrates a pump system for sinusoidal flow.

FIGS. 44 and 45 illustrate a pump system for sinusoidal flow. As shown in FIG. 44, two fluids can be introduced to inlets of a microreactor as described above via two reservoirs or tanks. Two pumps can be associated with each reservoir (tank) with one pump being configured for forward sinusoidal flow and the other pump being configured for reverse sinusoidal flow. In addition, pumps associated with the first reservoir (e.g., Pumps 1 and 2) can be configured to always be 180 degrees out of phase with the pumps associated with the second reservoir (e.g., Pumps 3 and 4).

Figure 46:
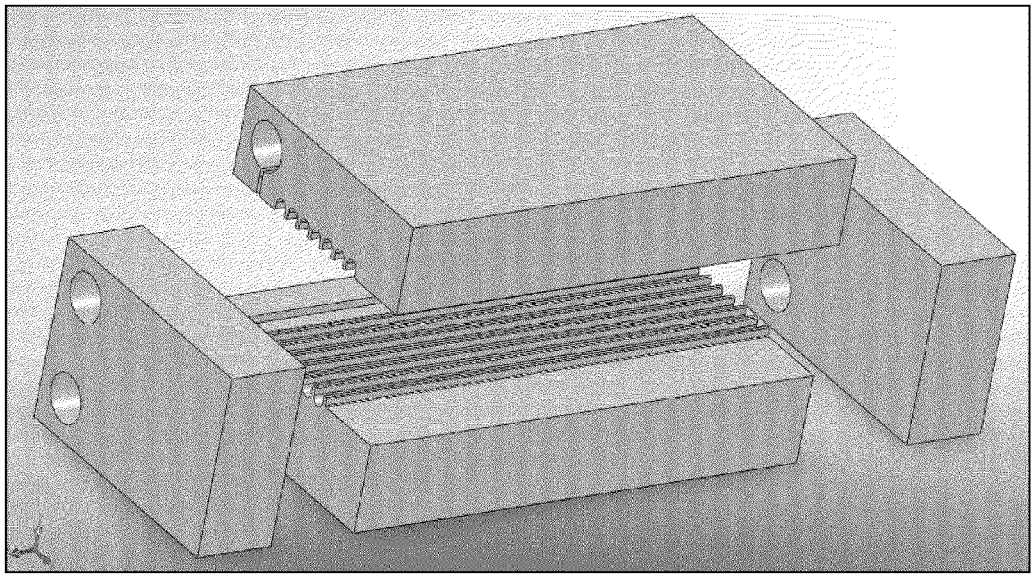
FIG. 46 illustrates a drawing showing an exploded view of a device with inlet headers and an embedded serpentine channel system machined into the bottom plate.
Figure 48:
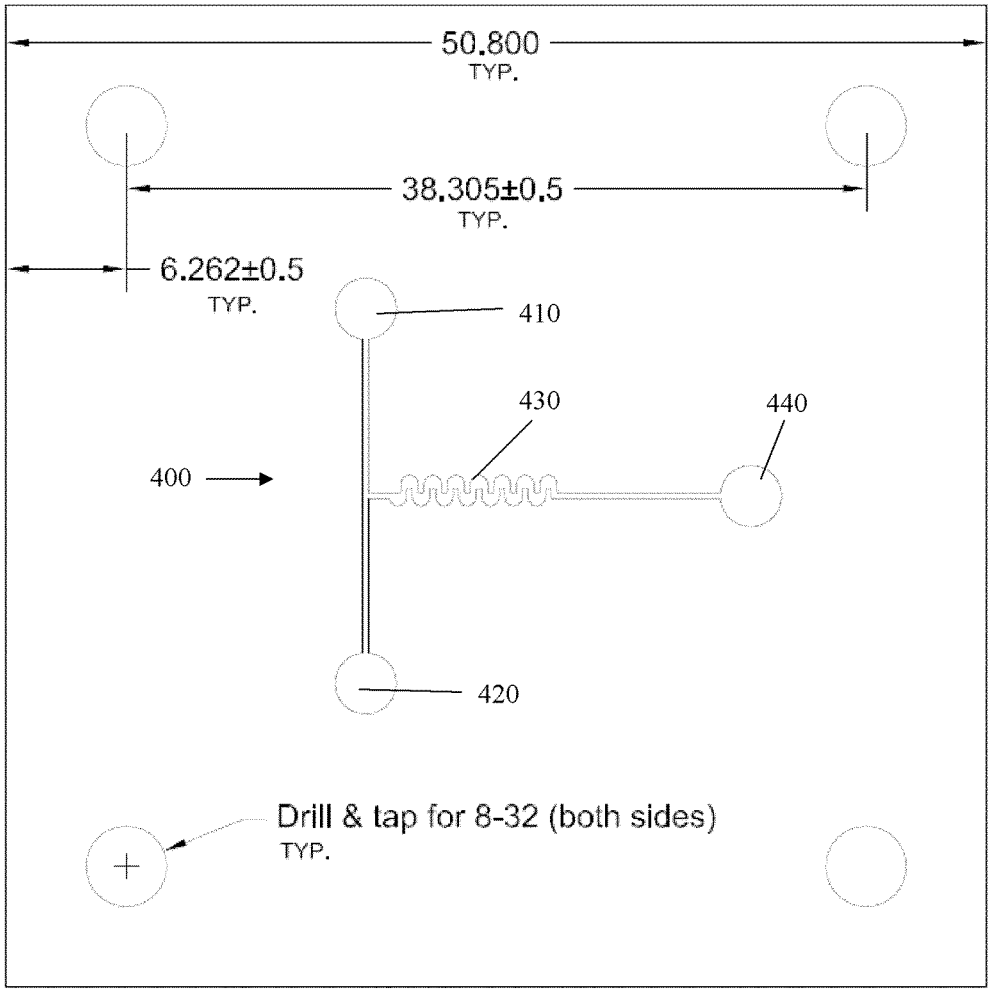
FIG. 48 illustrates another embodiment of a micromixer channel that can be machined using conventional cutting tools.
Figure 49:
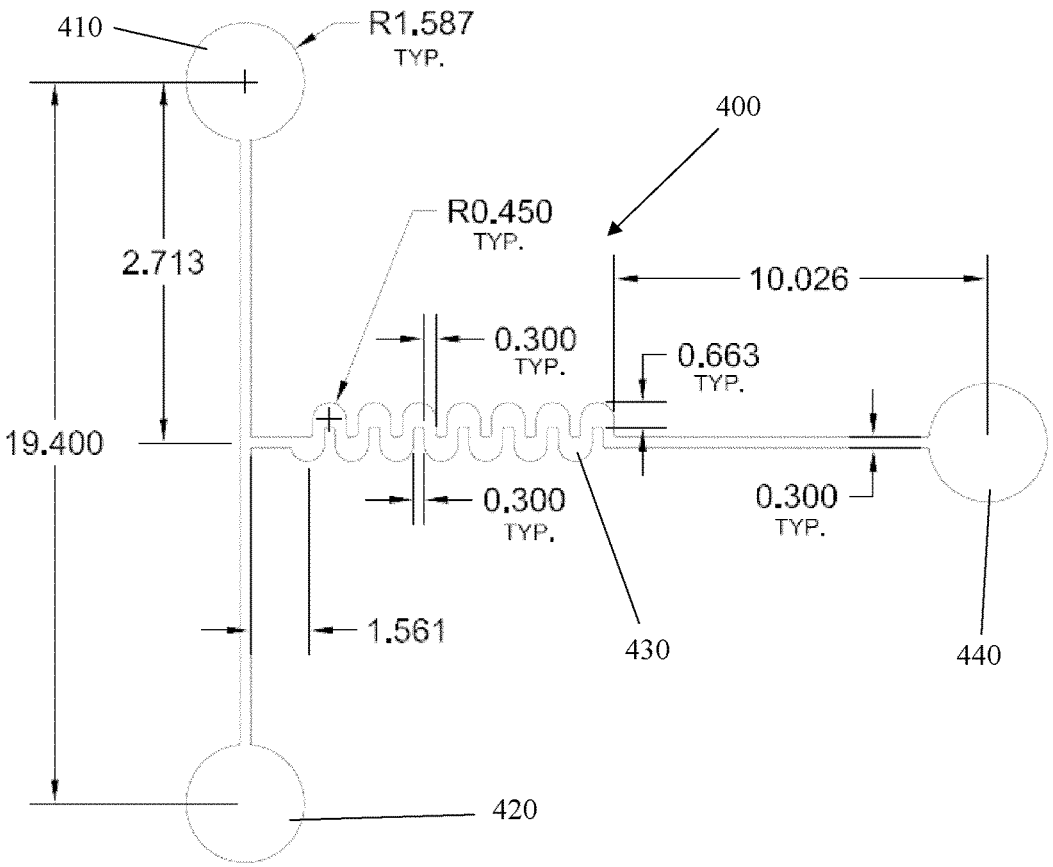
FIG. 49 illustrates another embodiment of a micromixer channel that can be machined using conventional cutting tools.

Another advantage is that these features can be embedded within a structure that can be scaled-up and disassembled as shown in FIG. 46. The serpentine fluid flow pathway of FIG. 46 is machined into the top and bottom members. The top and bottom members are removably coupled together and an end cap is added to both ends of the top and bottom members. Because the top and bottom members are removably coupled together, the serpentine fluid flow pathway can be accessed by disassembling the device for cleaning. In addition, the fabrication of the mixing region can be machined using, for example, commercially available tools (e.g., bits), such as those available from Kyocera. FIGS. 48 and 49 illustrate additional examples of embodiments that are capable of being machined. As shown in FIGS. 48 and 49, micromixers 400 comprises a first pump device 410 for pumping a first fluid, a second pump device 420 for pumping a second fluid, a serpentine pathflow 430, and a fluid outlet 440.

Figure 47:
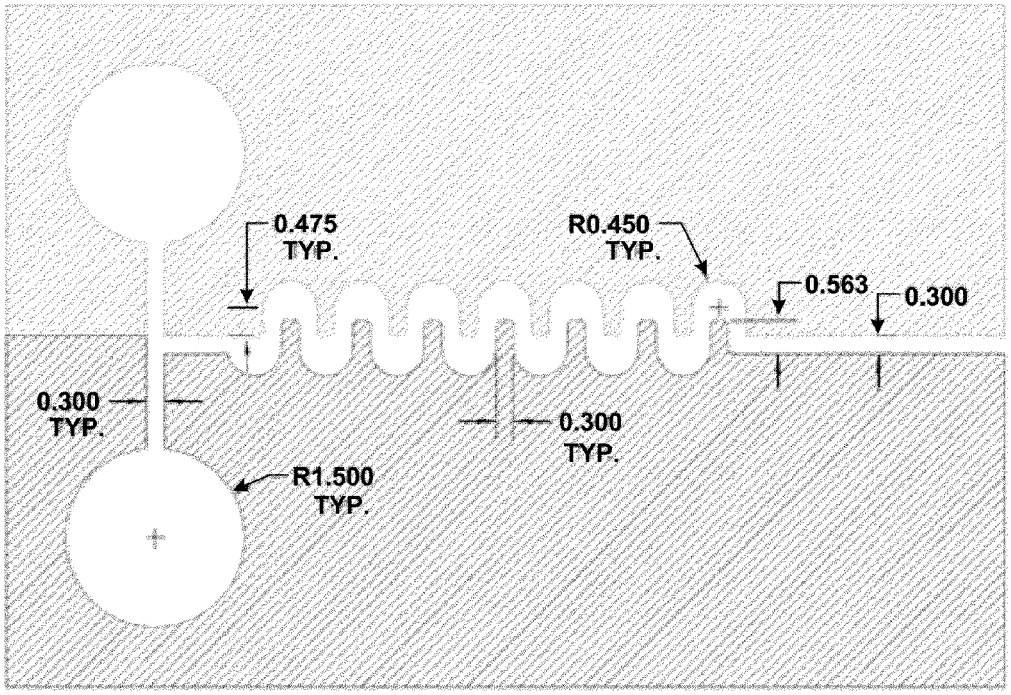
FIG. 47 illustrates a cross-section view of the top and bottom plates shown in FIG. 46 and reflecting dimensions that can be machined using conventional cutting tools.

If desired, heating inserts can be placed above and below nucleation regions to permit more precise control of temperature in the process. These structures can be optimized to allow for scale-up by lamination. Because channel sizes are much larger, fabrication is made easier. As noted above, FIG. 47 shows that cutting tools exist that can be used to make the needed structure in FIG. 46. Other methods also exist for making this geometry including wire electrodischarge machining. However, these features would not be machineable by these methods if they were below about 100 micrometers. Preferably, however, to help reduce clogging, the channel sizes are machined at a size that is greater than about 150 micrometers, more preferably greater than about 200 micrometers, and even more preferably greater than about 250 micrometers. Accordingly, if desired, other known methods can be implemented to manufacture the above described structures at smaller sizes.

Accordingly, the above embodiments disclose structures and methods for reducing mixing times within a scaled-up geometry. Desirably, the geometry is relatively easy to fabricate and can be disassembled for cleaning. In some embodiments, the microchannels can be much larger than conventional interdigital mixers and, therefore, are less likely to clog and easier to fabricate by multiple methods. The combination of this geometry with reverse oscillatory flow pumping can yield significantly reduced mixing times which is ideal for nanomaterial synthesis.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A micromixer device, comprising:

at least one fluid inlet channel and at least one fluid outlet channel; and a plurality of pathways between the at least one fluid inlet channel and the at least one fluid outlet channel, a width of at least some of the plurality of pathways varying in a substantially parabolic manner along at least one dimension of the micromixer device.

2. The device of claim 1, wherein the fluid inlet channel is located at a substantially central location relative to the plurality of pathways and the width of the pathways varies in a substantially parabolic manner as a function of the distance of the pathway from the fluid inlet channel.

3. The device of claim 1, wherein a plurality of structural elements define the pathways.

4. The device of claim 1, wherein the structural elements comprise channel walls that are substantially rectangular in shape.

5. The device of claim 1, wherein the device comprises a plurality of sections, with each section comprising a plurality of pathways that have substantially the same width, wherein the width of pathways vary from section to section in a substantially parabolic manner.

6. The device of claim 2, wherein the device comprises a base portion and two side walls that at least generally converge towards one another, and the fluid inlet channel is located substantially at the intersection of the two converging side walls.

7. The device of claim 6, wherein the location of the fluid inlet channel defines a central longitudinal axis of the device, and the lengths of the pathways vary according to their distance from the longitudinal axis, with the lengths of the pathways nearest the longitudinal inlet channel being longer than the lengths of the pathways furthest from the inlet channel.

8. The device claim 3, wherein the structural elements are pillars that are substantially cylindrical and which vary in width.

9. A microchannel mixer, comprising:

a first fluid inlet for introducing a first fluid into the mixer;

a second fluid inlet for introducing a second fluid into the mixer;

a serpentine fluid flow pathway;

a pump system with a first oscillatory flow pump device and a second oscillatory flow pump device, the first oscillatory flow pump device being operative coupled to the first fluid inlet and the second oscillatory flow pump device being operative coupled to the second fluid inlet configured wherein the first oscillatory flow pump device and second oscillatory flow pump device pump the first and second fluids, respectively, into the fluid flow pathway using reverse oscillatory flow;

wherein the first and second oscillatory flow pump devices both comprise two pump members, with each pump device having a first pump member configured for forward sinusoidal flow and a second pump member configured for reverse sinusoidal flow.

10. The mixer of claim 9, wherein the first and second oscillatory flow pump devices are configured to pump the first and second fluids, respectively, into the fluid flow pathway, with the first and second pump devices being 180 degrees out of phase with each other.

11. The mixer of claim 9, wherein the fluid flow pathway is machined to be about 200 micrometers or greater in width.

12. The mixer of claim 9, wherein the serpentine fluid flow pathway is defined by a top member and bottom member, the serpentine fluid flow pathway being machined into the top and bottom members, the top and bottom members being removably coupled together.

13. The mixer of claim 9, wherein the standard deviation of mass fraction at an outlet of the serpentine fluid flow pathway is less than about 0.06.

* * * * *